US006973760B2

(12) United States Patent
Moore

(10) Patent No.: US 6,973,760 B2
(45) **Date of Patent: *Dec. 13, 2005**

(54) MACHINE FOR PACKAGING CONTAINERS

(75) Inventor: Kevin Moore, Hoopeston, IL (US)

(73) Assignee: Ilinois Tool Works, Inc., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/614,477

(22) Filed: Jul. 7, 2003

(65) Prior Publication Data

US 2004/0003573 A1 Jan. 8, 2004

Related U.S. Application Data

(63) Continuation-in-part of application No. 10/080,271, filed on Feb. 21, 2002, now Pat. No. 6,588,173.

(51) Int. Cl.[7] ..... B65B 53/00
(52) U.S. Cl. ..... 53/48.4; 53/201
(58) Field of Search ..... 53/398, 201, 48.4, 53/48.3, 48.2

(56) References Cited

U.S. PATENT DOCUMENTS 3,032,944 A * 5/1962 Hull et al. ..... 53/48.4
3,959,949 A * 6/1976 Benno et al. ..... 53/398
3,991,640 A * 11/1976 Schlueter ..... 83/341
4,324,085 A 4/1982 Olsen
4,501,104 A * 2/1985 Griffin et al. ..... 53/48.4
5,054,257 A * 10/1991 Cunningham et al. ..... 53/48.4
5,117,609 A 6/1992 Seymour et al.
5,383,321 A 1/1995 Krogman et al.
5,542,231 A 8/1996 Ungar et al.
5,813,193 A * 9/1998 Chan et al. ..... 53/398
6,122,893 A 9/2000 Weaver et al.
6,170,225 B1 1/2001 Cervantes et al.
6,588,173 B1 7/2003 Moore et al.

FOREIGN PATENT DOCUMENTS

EP 1 207 105 A1 11/2001

* cited by examiner

*Primary Examiner*—John Sipos
(74) *Attorney, Agent, or Firm*—Pauley Peterson & Erickson

(57) ABSTRACT

A machine for packaging multiple containers wherein a flexible carrier stock is fed across a jaw drum. A plurality of containers are also moved through the machine whereby the carrier is subsequently positioned over the plurality of containers so that flexible carrier stock engages with one of the containers to form a package. The machine is adjustable to accommodate a range of container heights and sizes, carrier configurations and/or package sizes. In addition, movement of the various components of the machine is coordinated using a drive system and a controller.

16 Claims, 20 Drawing Sheets

MACHINE FOR PACKAGING CONTAINERS

CROSS REFERENCE TO RELATED APPLICATIONS

This application is a continuation-in-part of U.S. patent application Ser. No. 10/080,271, filed Feb. 21, 2002, now U.S. Pat. No. 6,588,173, issued 8 Jul. 2003.

BACKGROUND OF THE INVENTION

1. Field of the Invention

This invention relates to a machine for unitizing a plurality of containers using a flexible container carrier.

2. Description of Prior Art

Container carriers connect two or more containers into a sturdy unitized package of containers. Carriers are generally planar arrays of rings, sometimes referred to as "six-pack carriers," typically formed from a thermoplastic sheet material. Carriers are applied to containers of various sizes and shapes along various points along the sidewall or under the chime of the container. A preferable machine would be capable of application of a container carrier to a wide range of container sizes in a number of different package sizes in one of several positions along the container sidewall and/or chime.

Prior art multi-packaging devices and methods generally require several different versions or configurations of machines to accommodate different container carrier, package sizes and package configurations. Machines are traditionally a limitation on the range of container diameters, size of package or configuration of package that can be effectively packaged by a single system.

In addition, different machines or complex set-up procedures would also be required for different sizes of packages, for instance 4-packs, 6-packs and/or 12-packs. Each different package size would typically require different machines and/or complex set-up of machine configurations to accommodate division and diversion of differently sized packages.

Finally, different machines or complex set-up procedures would also be required for containers having different heights or requiring application along different points along the container sidewall and/or chime. Two traditional configurations of container carrier to container are the sidewall-applied carrier (SAC) position and the rim-applied carrier (RAC) position. A sidewall-applied carrier requires that the carrier is applied lower along the container than the rim-applied carrier. As such, different machines and/or set-up procedures are traditionally required to bring the carrier up or down along the container. Likewise, such different equipment and/or set-up procedures are traditionally required to package containers having different overall heights.

SUMMARY OF THE INVENTION

It is one object of this invention to provide a machine that combines speed, flexibility, quick changeover and ease of operation and maintenance.

It is another object of this invention to provide a machine for unitizing a plurality of containers along two or more positions along the container sidewall, for example, with a sidewall-applied carrier, or under the chime, for example, with a rim-applied carrier.

It is one object of this invention to provide a machine for unitizing a plurality of containers using a carrier having a range of possible configurations and/or sizes.

It is another object of this invention to provide a machine for unitizing a plurality of containers in one of several possible multipackage sizes.

It is another object of this invention to provide a machine for unitizing a plurality of containers having a range of possible container heights, diameters and/or sizes.

It is a further object of this invention to provide electronic control among various components of a machine for unitizing a plurality of containers.

A machine for packaging multiple container heights, using multiple container carriers and/or multiple package sizes includes a carrier that moves through a jaw drum. The carrier is positioned around a perimeter of the jaw drum, and rotates onto uniform groups of containers. The containers are assembled and unitized in a single package. After a brief set-up period, a uniform group of containers having a second physical size, a second package size, a second package configuration, for example a carrier positioned along a second position along a carrier sidewall or a carrier chime and/or a second carrier size may be packaged with the machine according to this invention.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
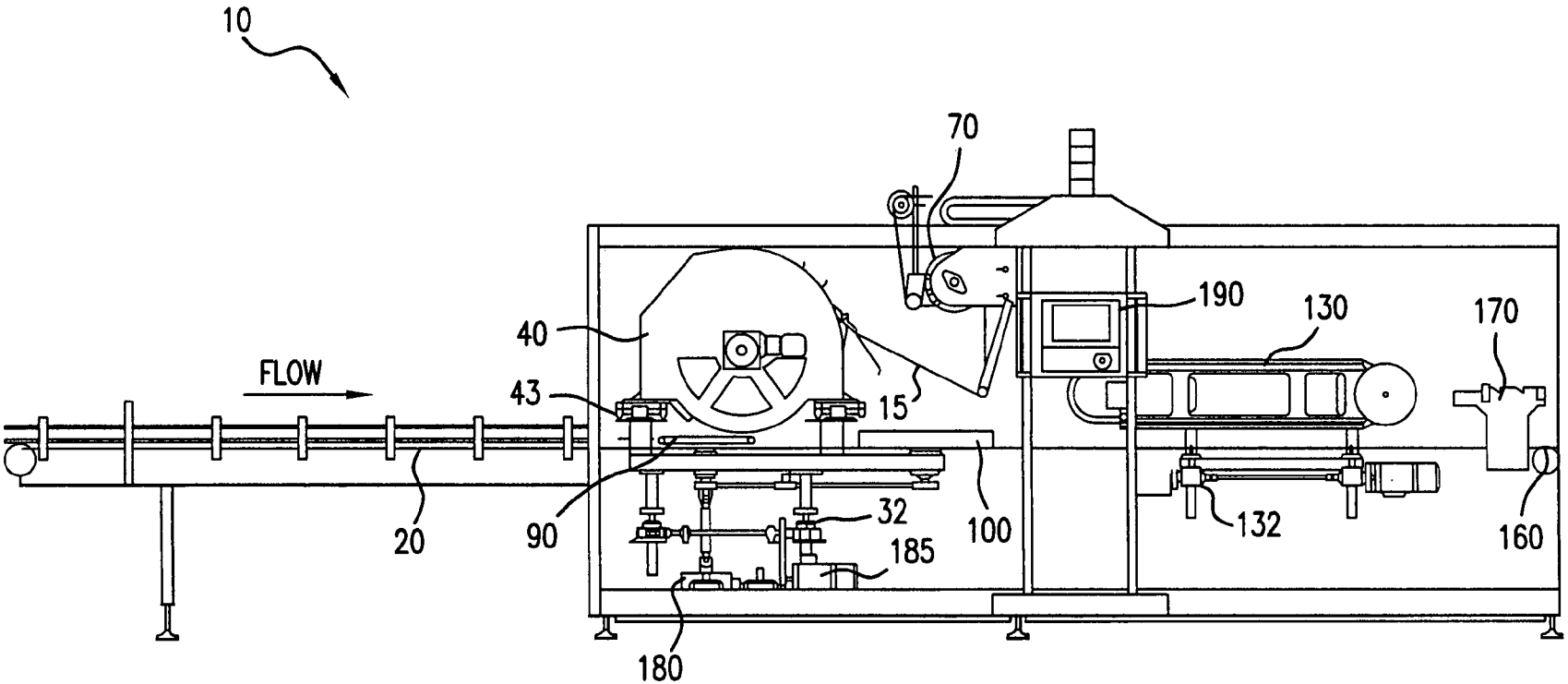
FIG. 1 is a side view of a machine for packaging containers according to one preferred embodiment of this invention.
Figure 2:
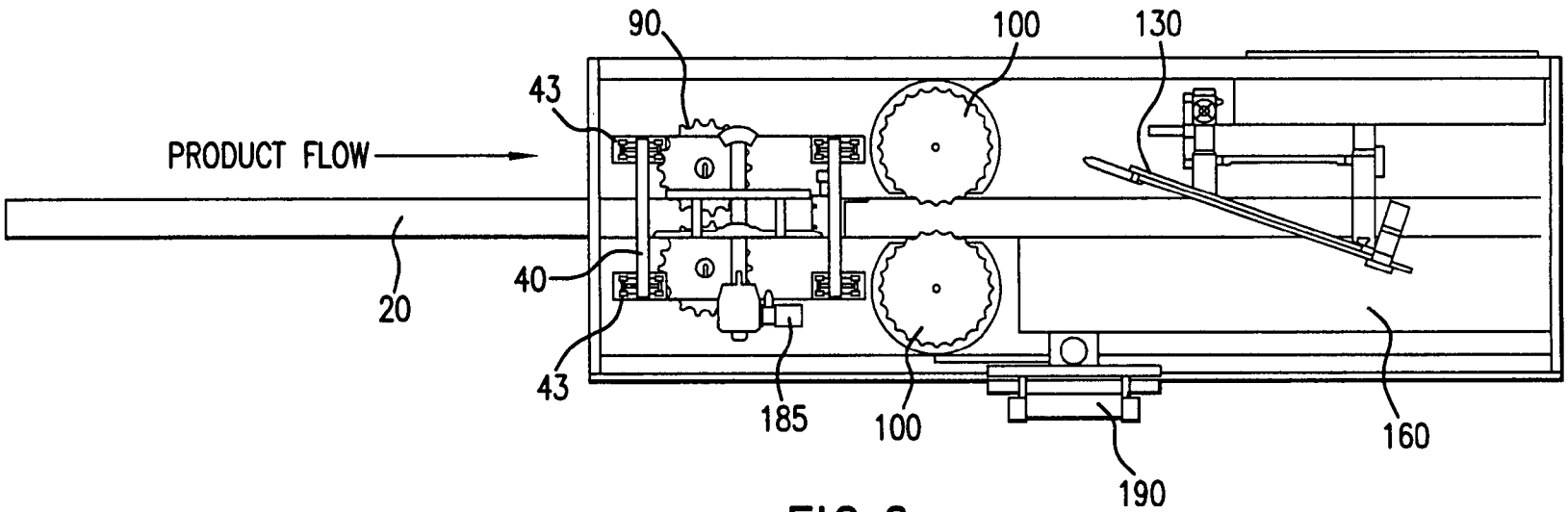
FIG. 2 is a top view of a machine for packaging containers according to one preferred embodiment of this invention.

FIGS. 1 and 2 show a machine for packaging multiple containers in a carrier according to one preferred embodiment of this invention. As shown, carrier stock 15 moves through machine 10, specifically through jaw drum 40, where it is applied to containers and then separated into individual, unitized packages. According to one preferred embodiment of this invention, if a uniform group of like-sized containers having a different size requires packaging and/or if a package is required having a different configuration, for example along a sidewall or chime of the container and/or if a different carrier is required, a separate machine is unnecessary as machine 10 may be quickly reconfigured, following various adjustments to machine 10, as described below.

Therefore, the machine 10 for packaging multiple containers in multiple size packages along multiple locations on the container sidewall and/or chime according to this invention permits the use of a single machine in combination with a variety of sizes of containers, sizes of packages and configurations of packages. Traditional machines are typically fifteen or more feet long and six or more feet wide, therefore a reduction in the number of machines required in a packaging plant significantly reduces the required working floor space within the plant. In addition, quick and generally toolless set-up and changeover results in more efficient packaging operations.

Carrier preferably moves through machine 10 from a reel where carriers are dispersed in a continuous string of carrier stock 15 and ultimately to packages where each carrier is separated into a unitized package, each package containing a plurality of uniform containers. A typical configuration for a package is a "six-pack" containing two longitudinal rows of containers in three transverse ranks. Additional desired packages such as four-packs, eight packs and twelve packs may be unitized using machine 10 according to this invention, and such additional sizes of packages are limited only by the consumer market for such additional sizes.

Carrier (and carrier stock) is preferably constructed from a flexible plastic sheet, such as low-density polyethylene. The flexible plastic sheet is punched or otherwise formed into a plurality of container receiving apertures aligned in transverse ranks and at least two longitudinal rows to form a continuous sheet of carriers. The container receiving apertures are preferably oriented in a longitudinal direction with respect to carrier. Carrier may also include features such as a handle for holding carrier along either a side or a top of the package and/or a merchandising panel for displaying product and/or promotional information. Additionally, features such as tear tabs and perforations may be included in the carrier to ease removal of the containers from carrier.

According to one preferred embodiment of this invention, machine 10 for packaging multiple containers includes moving carrier stock 15 through machine 10 from a reel stand (not shown). Carrier stock 15 then enters machine 10 across feed drum 70 and into jaw drum 40. Following application to containers, carrier stock 15 is divided into individual carriers using cut-off wheel resulting in individually unitized packages of a desired size which are then dispersed to a case packer (not shown) using turner/diverter 130. Each of these steps and components to machine 10 is described in detail in the following description of preferred embodiments of this invention, including various components that are convertible or exchangeable to permit machine 10 to address a wide range of packaging requirements.

Figure 14:
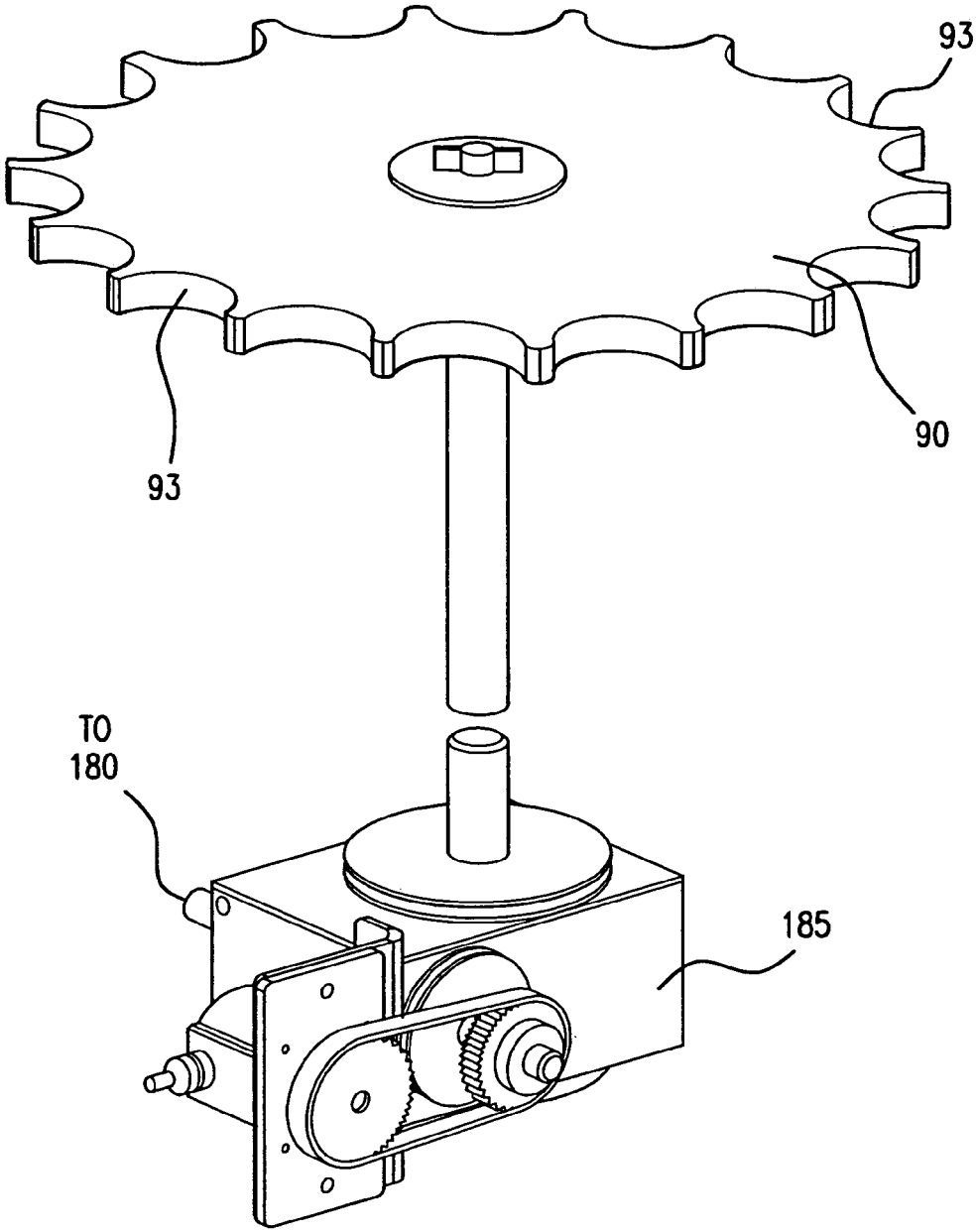
FIG. 14 is a side perspective view of a drive means and star wheel according to one preferred embodiment of this invention.
Figure 27:
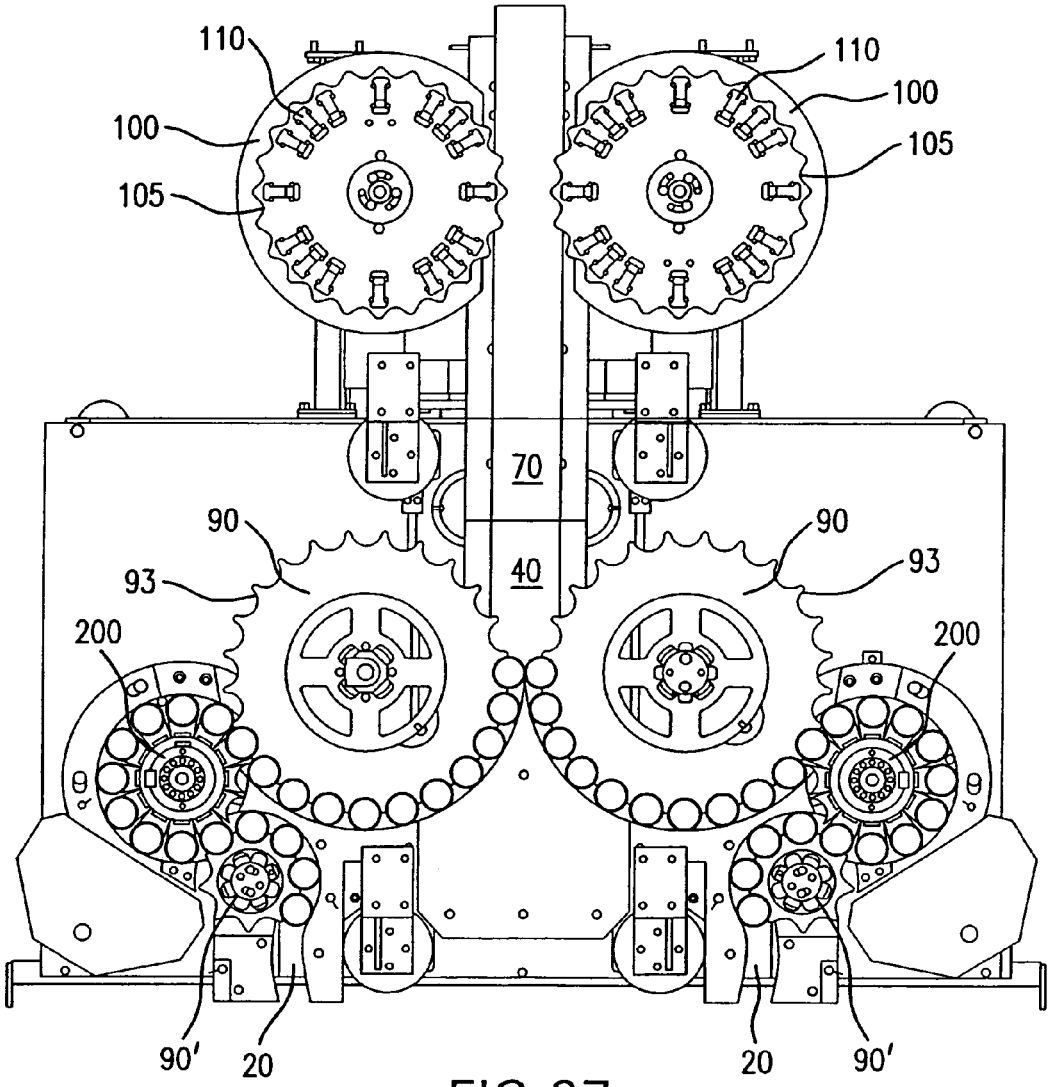
FIG. 27 is a top view of a machine for packaging containers according to one preferred embodiment of this invention.

Machine 10 includes an input conveyor 20 for conveying the containers longitudinally into a platform of machine 10, in preferably two longitudinal rows, and an output conveyor 30 for conveying the containers longitudinally from the platform after the carrier stock has been applied. According to a preferred embodiment of this invention, star wheel 90 is positioned on each side of machine 10 to accept containers from input conveyor 20 and/or orienter 200, as shown in FIG. 27 and described in more detail below. Star wheel 90, such as shown in FIG. 14, typically includes a plurality of container pockets 93 for locating the containers for proper application of carrier stock 15 to such containers. The plurality of containers moves through machine 10 and each container is spaced apart from an adjacent container by star wheel 90. The spacing between adjacent containers as they enter machine 10 depends upon the relative sizing of container pockets 93 which are preferably sized to accommodate the largest diameter container to be used in machine 10. Star wheel 90 may be replaceable with substitute star wheels having a different thickness or different surface geometry, such as to accommodate non-conventional container shapes, such as contoured cans. As discussed in more detail below, carrier stock 15 is subsequently positioned over the plurality of containers whereby each container receiving aperture engages with one of the containers to form a package having a predetermined number of containers.

Each operative component of machine 10 is adjustable to permit packaging of containers having different sizes, carriers having different sizes, packages having different sizes, such as six-packs and twelve-packs, and packages having different configurations, namely rim-applied carrier (RAC) configurations and side-applied carrier (SAC) configurations. In each of these different applications, multiple components of machine 10 may be adjusted, replaced and/or interchanged to permit application of carrier stock to containers. Several of these components are described in more detail below.

Feed Drum

Figure 10:
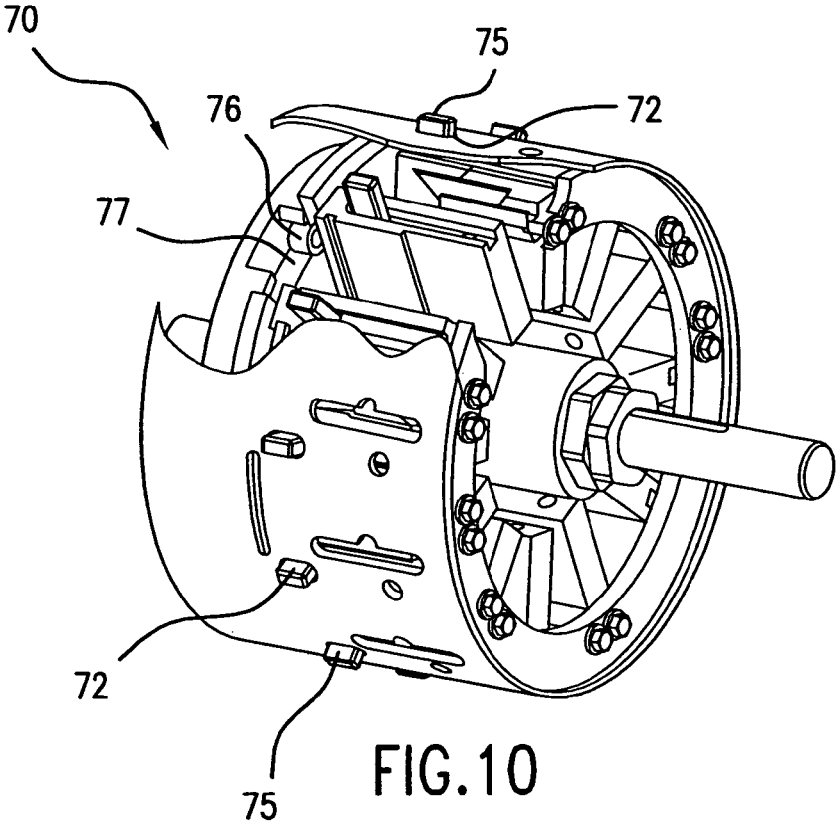
FIG. 10 is a side perspective cutaway view of a feed drum according to one preferred embodiment of this invention.
Figure 12:
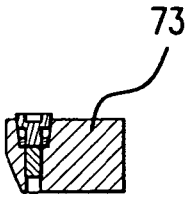
FIG. 12 is a section view of the feed knife shown in FIG. 11.
Figure 11:
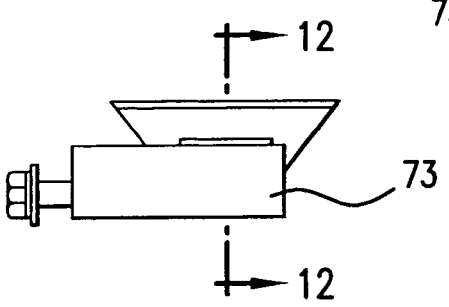
FIG. 11 is a side view of a feed knife used in the feed drum shown in FIG. 10.

As carrier stock 15 is dispersed from reel stands (not shown) to jaw drum 40, feed drum 70 is used to maintain tension in the carrier stock 15. Feed drum 70, as shown in detail in FIG. 10, preferably includes a plurality of removable pins 75 that are operatively connected to a feed cam 77. Feed cam 77 preferably extends and retracts removable pins 75 as feed drum 70 is rotated for engagement and disengagement with carrier stock 15 as carrier stock 15 is fed to jaw drum 40. As shown in FIG. 10, removable pins 75 are preferably each operatively associated with cam follower 76 which follows feed cam 77 to extend and retract removable pins 75 as they rotate with feed drum 70.

Depending upon the desired configuration of carrier stock 15, container receiving openings may be configured in generally rectangular or generally triangular shapes. As such, removable pins 75 having a first cross-section may be interchangeably replaceable with removable pins 75 having a second cross-section, such as circular or rectangular cross-sections. In particular, the cross-section of the heads of removable pins 75 are interchangeable so that a particular head can closely engage with container receiving openings of different shapes. Removable pins 75 are preferably placed around circumference of feed drum 70 so that one removable pin engages with each container receiving opening, thereby creating sufficient tension in carrier stock 70 prior to transfer to jaw drum 40.

According to one preferred embodiment of this invention, removable pins 75 and/or feed drum 70 may be coded with numbers, colors, symbols and/or words to facilitate changeover to a particular pin configuration and/or cross-section suited to the particular carrier stock 15 positioned in machine 10. For example, removable pins 75 having a blue color or color code may correspond with a six-pack arrangement requiring placement of removable pins 75 within every other pin receiver 72 around the circumference of feed drum 70. Such pin receivers 72 may additionally include a coded marking system for placement of removable pins 75. Removable pins 75 may be further coded to distinguish use in connection with carrier stock 15 having rectangular container receiving openings (for use with rectangular cross-section removable pins) from carrier stock 15 having generally rounded container receiving openings (for use with circular cross-section removable pins).

In addition, feed drum 70 preferably includes a plurality of feed knives 73 that are adjustably positioned around a circumference of feed drum 70. Feed knives 73 preferably protrude just beyond an outer surface of feed drum 70 and are used to trim and/or cut away particular non-useful features of carrier stock 15 to facilitate application to containers. Particularly, feed knives 73 may be used to separate portions of adjacent carriers in carrier stock 15 that are attached to facilitate winding and unwinding of carrier stock 15 from reels. A pressure wheel may be positioned directly adjacent feed drum 70 to apply light pressure to carrier stock 15 to facilitate cutting of carrier stock 15 by feed knives 73.

Figure 13:
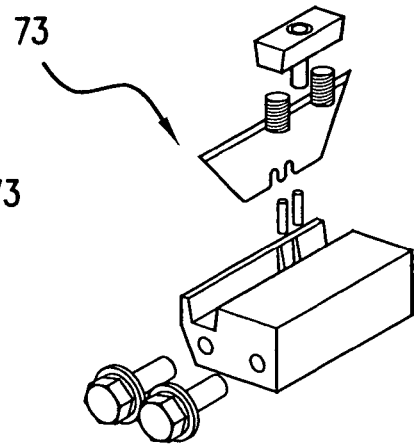
FIG. 13 is a front perspective view of the feed knife shown in FIG. 11.

Feed knives 73 may additionally include coding such as colors, symbols, etc. to permit changeover between various applications and/or configurations of carrier stock 15. For example, feed knives 73 may additionally be labeled with a color code to indicate use with a particular size carrier stock 15. As such, for a six-pack arrangement, feed knives 73 having a blue code may be positioned within feed drum 70 to correspond with where a preliminary cut may be required along carrier stock 15, for example, between handles of carrier stock 15 or between additional connections between adjacent carriers required to facilitate winding and unwinding of carrier stock 15. FIG. 13 shows one preferred embodiment of how feed knives 73 are attached and detached relative to feed drum 70.

Feed Trough

Figure 8:
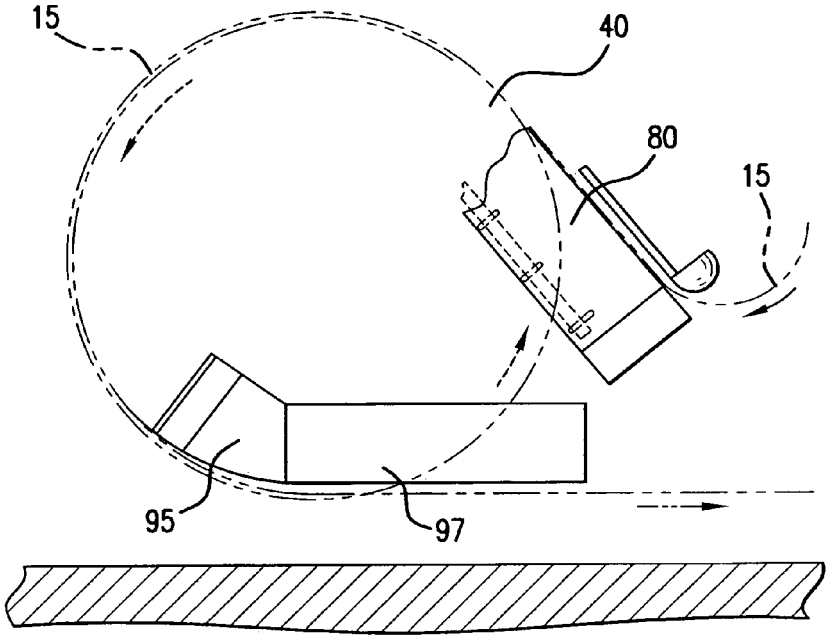
FIG. 8 is a side schematic view of a jaw drum, feed trough and stripper shoe according to one preferred embodiment of this invention.
Figure 9:
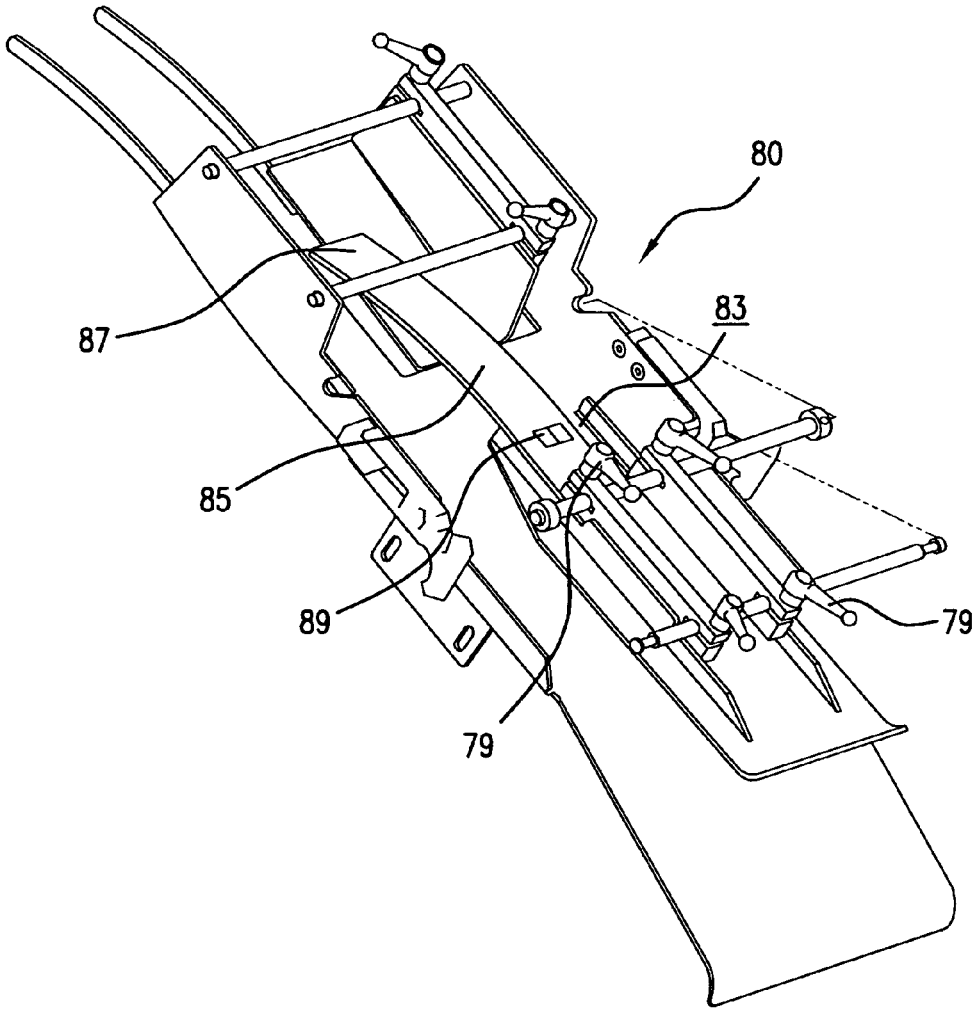
FIG. 9 is a side perspective view of a feed trough according to one preferred embodiment of this invention.

Carrier stock 15 is preferably transported from feed drum 70 to jaw drum 40 across feed trough 80, as shown in FIG. 8. Feed trough 80, as best shown in FIG. 9, preferably urges carrier stock 15 into direct engagement with jaw drum 40. Feed trough 80 preferably includes sled 85 under which carrier stock 15 passes so as to directly engage with jaw pairs 45 of jaw drum 40.

Sled 85 preferably includes tongue 87 and slot 83 which are sized depending upon a relative size of carrier stock 15 and/or a configuration of the desired package. Accordingly, as jaw drum 70 is adjusted, a corresponding sled 85 having a suitable geometry may be interchanged within feed trough 80 to facilitate feeding carrier stock 15 onto jaw drum 70. As shown in FIG. 9, adjustment knobs 79 may be positioned on feed trough 80 to facilitate toolless removal and replacement of sleds 85 and/or adjustment of feed trough 80.

According to a preferred embodiment of this invention, and like many features of machine 10, feed trough 80 includes one or more components or modules that are interchangeable based upon the size and/or configuration of carrier stock 15, and thus particularly sized or configured for use with a specific application. In particular, feed trough 80 and specifically sled 85 may include coded marking system 89 that includes symbols, colors, numbers and/or words corresponding with the particular application desired. For instance, feed trough 80 may include interchangeable sled 85 having coded marking system 89 marked with two blue squares to indicate use in connection with a six-pack (for example, corresponding with the color blue) and a rim-applied (RAC) configuration (for example, corresponding with two squares).

According to a preferred embodiment of this invention, each component or module of machine 10 that includes interchangeable parts includes a consistent coded marking system so that an operator can not only replace each interchangeable component when a changeover in machine 10 is required but also immediately recognize those components that are incorrectly placed for a particular set-up. For example, if a blue code is used to correspond with a six-pack carrier, then the operator can replace each coded component with one having a blue color. Should a red coded component improperly remain on machine 10 following changeover to a six-pack set-up (from, for example, an eight-pack set-up), such component would be visibly recognizable as incorrect and thus quickly replaceable with a correct blue coded component.

Jaw Drum

Carrier stock 15 proceeds from feed trough 80 to jaw drum 40, particularly to jaw pairs 45 located radially about jaw drum 40. Jaw drum 40 preferably comprises a cylindrical member rotatable about a horizontal axis which transports carrier stock 15 from feed drum 70 to the plurality of containers which flow through jaw drum 40. A plurality of jaw pairs 45 are preferably equally spaced around a perimeter of jaw drum 40. Radial positions of jaw pairs 45 around the perimeter of jaw drum 40 are preferably permanently fixed.

Jaw drum 40 is preferably adapted to move a first distance in a direction transverse to the flow direction of the plurality of containers and responsively move a predetermined second distance in the flow direction. Jaw drum 40 is preferably further adjustable to change a distance between jaw pairs 45 in an open position. In addition, jaw drum 40 is preferably adapted to move vertically relative to the flow direction of the plurality of containers. Each of these areas of adjustment are described in more detail below.

Figure 5:
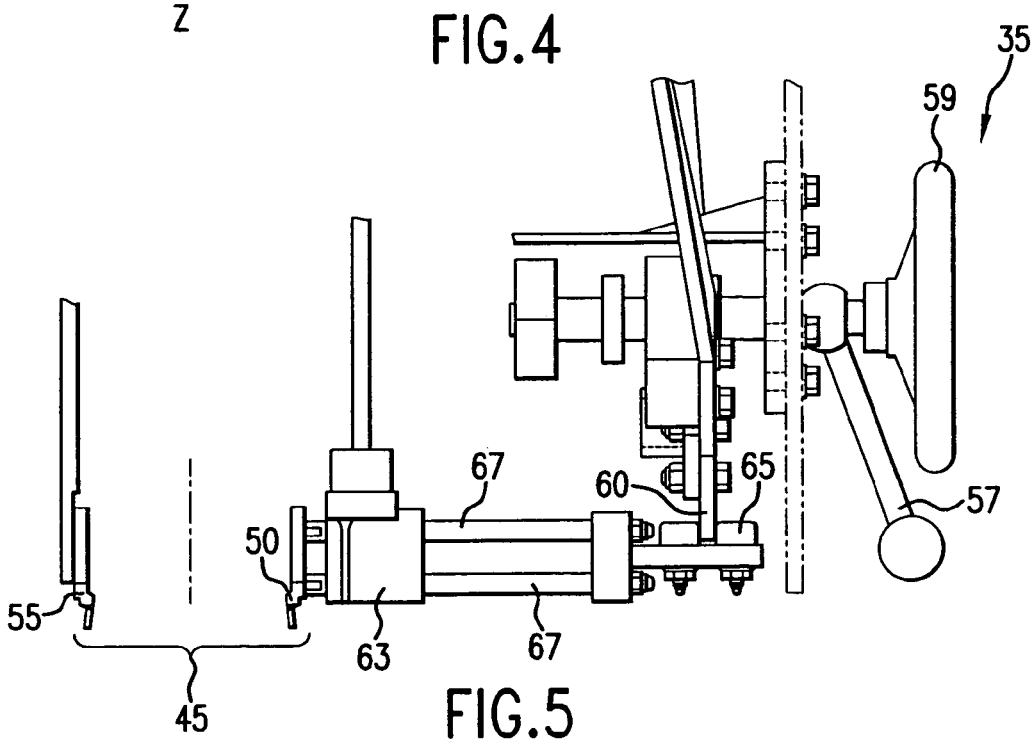
FIG. 5 is a front view of an adjustment means of a jaw drum according to one preferred embodiment of this invention.

As best shown in FIG. 5, according to one preferred embodiment of this invention, each jaw pair 45 comprises fixed jaw 55 and moveable jaw 50. In one preferred embodiment of this invention, jaw pairs 45 are moved between an open position and a closed position through the use of a cam follower 65 connected with respect to rods 67 and cam 60. Cam 60 is preferably independently fixed with respect to jaw drum 40. Moveable jaws 50 are preferably connected to cam follower 65 that follows cam 60 positioned around a perimeter of jaw drum 40. Cam follower 65 is preferably journaled through a support block 63 and longitudinally reciprocates relative to support block 63 and thus cam 60.

According to one preferred embodiment of this invention, each fixed jaw 55 is aligned around one perimeter edge of jaw drum 40 and each moveable jaw 50 is aligned opposite each corresponding fixed jaw 55. Each resulting jaw pair 45 is preferably spaced equidistantly around the perimeter of jaw drum 40 from each other jaw pair 45.

According to one preferred embodiment of this invention, each jaw pair 45 is movable between a closed position and an open position along an axis parallel to the horizontal axis of rotation of jaw drum 40. The closed position comprises a relative position of jaw pair 45 when moveable jaw 50 is in a closest desired position relative to fixed jaw 55. The open position comprises a relative position of jaw pair 45 when moveable jaw 50 is in a farthest desired position relative to fixed jaw 55. As a result of the cammed relationship between fixed jaw 55 and moveable jaw 50, the relative position of moveable jaw 50 with respect to fixed jaw 55 changes as jaw drum 40 is rotated through a full 360° rotation.

Each jaw pair 45 is configured to grip carrier stock 15 with moveable jaw 50 and fixed jaw 55 engaged through each transverse pair of container receiving apertures in carrier stock 15. The circumferential spacing between adjacent jaw pairs 45 is preferably approximately equal to a pitch of carrier, i.e., the distance between adjacent centers of container receiving openings. The lateral spacing between moveable jaw 50 and fixed jaw 55 in the closed position is preferably slightly less than a width between transverse pairs of container receiving apertures. Carrier stock 15 is engaged with moveable jaw 50 and fixed jaw 55 of jaw drum 40 immediately prior to application to containers.

As discussed above, feed trough 80 is preferably configured to feed carrier stock 15 to jaw pairs 45 so that sled 85 of feed trough 80 is aligned precisely with spacing of jaw pair 45. As such, slot 83 and tongue 87 of sled 85 preferably mates with at least one of moveable jaw 50 and fixed jaw 55 so that carrier stock 15 is closely and precisely guided from feed trough 80 to jaw pairs 45 of jaw drum 40.

Figure 4:
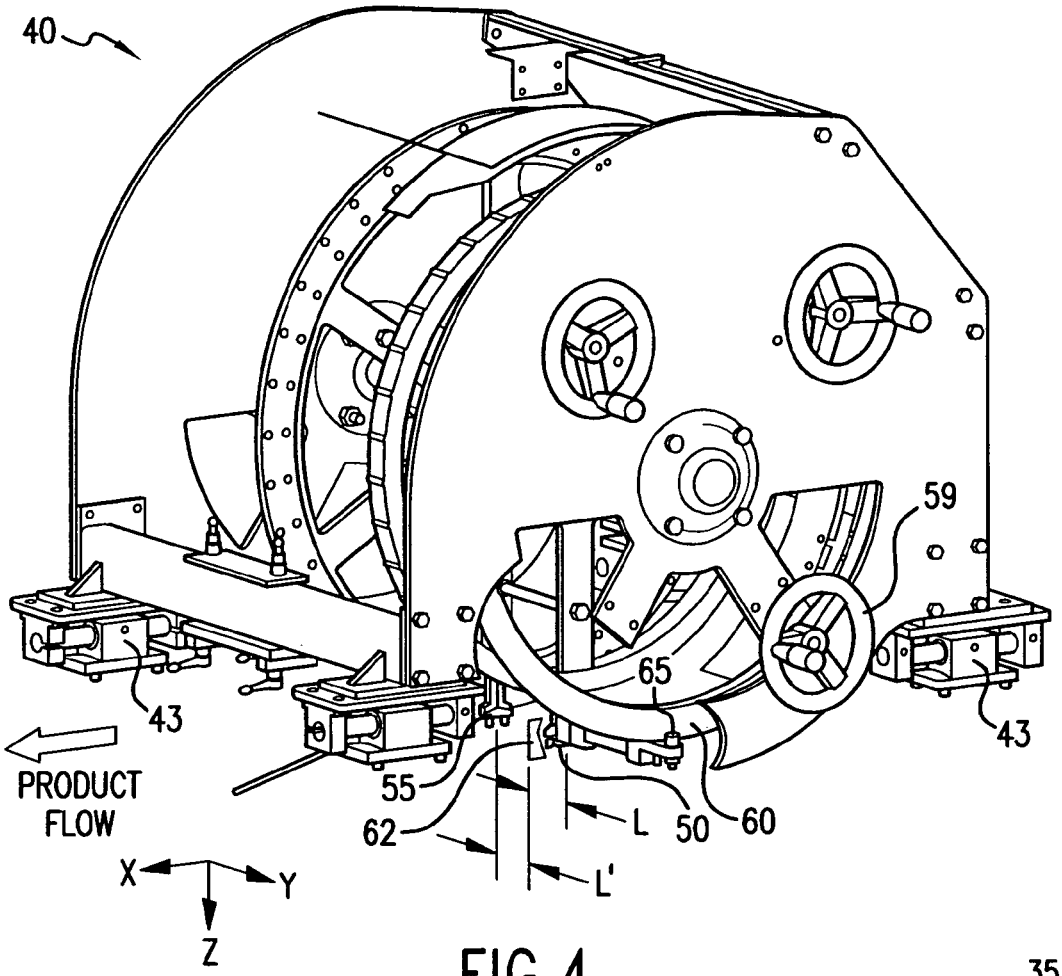
FIG. 4 is an opposite side perspective cutaway view of the jaw drum shown in FIG. 3.

Jaw drum 40 further comprises adjustment means 35 for predetermined and precise adjustment of a distance between each jaw pair 45 in the closed position and/or open position. According to one preferred embodiment of this invention, adjustment means 35 adjusts moveable jaw 50 and/or fixed jaw 55 of each jaw pair 45, such as by adjustment of cam 60, as best shown in FIGS. 4 and 5. In one preferred embodiment of this invention, adjustment means 35 adjusts cam 60 outwardly or inwardly depending upon desired spacing between jaw pairs 45 in an open position so that moveable jaw 50 moves farther or closer to fixed jaw 55 in the open position.

Figure 20:
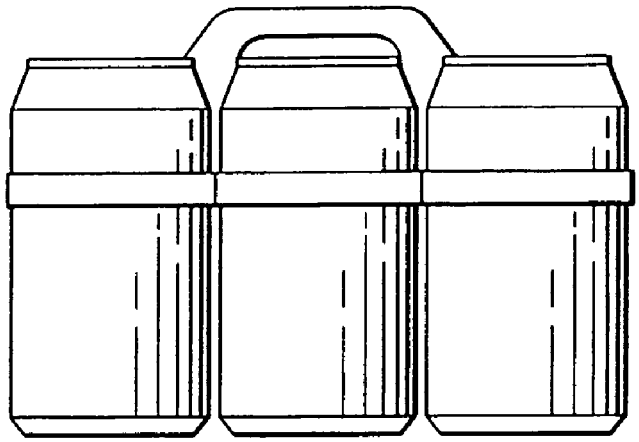
FIG. 20 is a side view of a package of containers using a side-applied carrier configuration.
Figure 21:
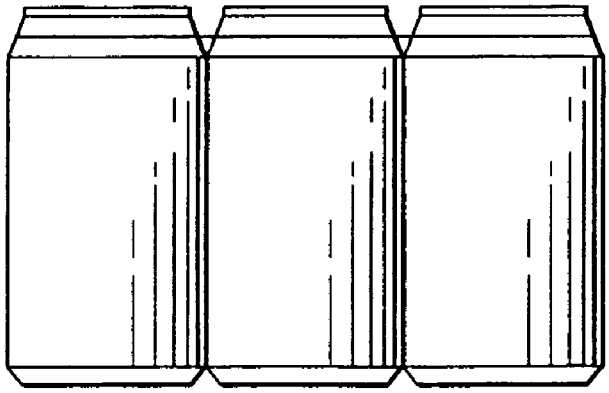
FIG. 21 is a side view of a package of containers using a rim-applied carrier configuration.

As jaw pairs 45 move with the rotation of jaw drum 40 from a closed position to an open position, container receiving apertures within carrier stock 15 stretch to accommodate a container. Carrier stock 15 in a stretched condition is positioned over a plurality of containers so that each container receiving aperture engages with one container. Upon engagement with the containers, carrier stock 15 is released from jaw pair 45 and grips a perimeter of container, either around a chime in a rim-applied carrier (RAC) configuration, such as shown in FIG. 21, or around a sidewall in a sidewall-applied carrier (SAC) configuration, such as shown in FIG. 20.

Figure 6:
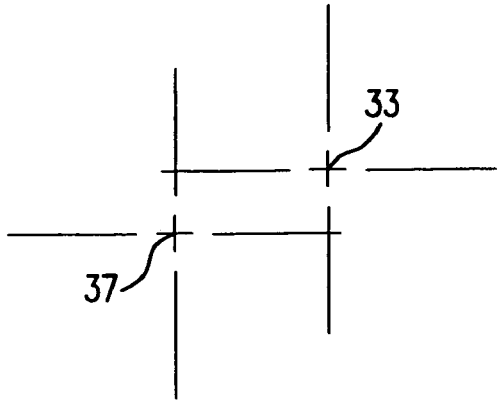
FIG. 6 is a side schematic view of the positions of a jaw drum relative to containers in both a side-applied carrier (SAC) application and a rim-applied carrier (RAC) application.
Figure 6:
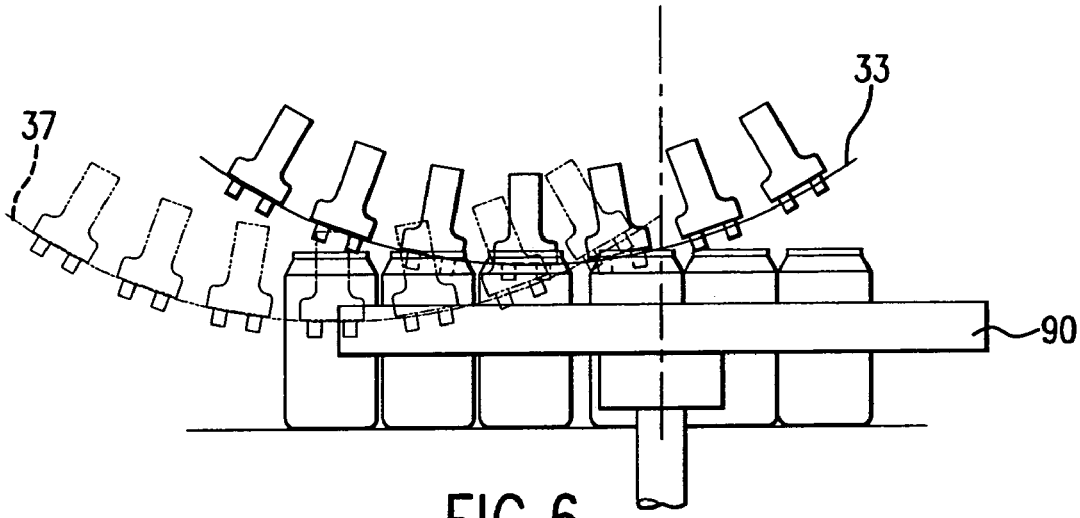
Figure 7:
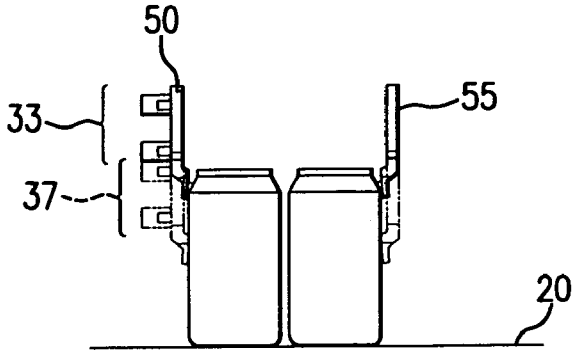
FIG. 7 is a front schematic view of the positions of the jaw drum relative to the containers as shown in FIG. 6.

FIGS. 6 and 7 show a position of jaw drum relative to containers for both a RAC and a SAC configuration. In a RAC configuration, jaw drum 40 is positioned in a first position 33 relative to inlet conveyor 20 so that jaw pairs 45 properly engage containers to position carrier stock 15 about a chime of each container as shown in FIG. 21. When a SAC configuration is desired, jaw drum 40 is preferably moved to a second position 37 relative to inlet conveyor 20 and relative position of moveable jaw 50 with fixed jaw 55 is also adjusted so that jaw pairs 45 properly engage containers to position carrier stock 15 about the sidewall of container as shown in FIG. 20. Such adjustment of jaw drum 40 into a second position 37 is necessary to permit jaw pairs 45 adequate spacing to extend downward around container sidewalls. FIG. 7 shows the first position 33 and the second position 37 of jaw drum 40 and particularly moveable jaw 50 and fixed jaw 55 relative to containers so that carrier stock is applied along a proper position along the sidewall of the container for a SAC configuration or along the chime of the container for a RAC configuration.

Figure 3:
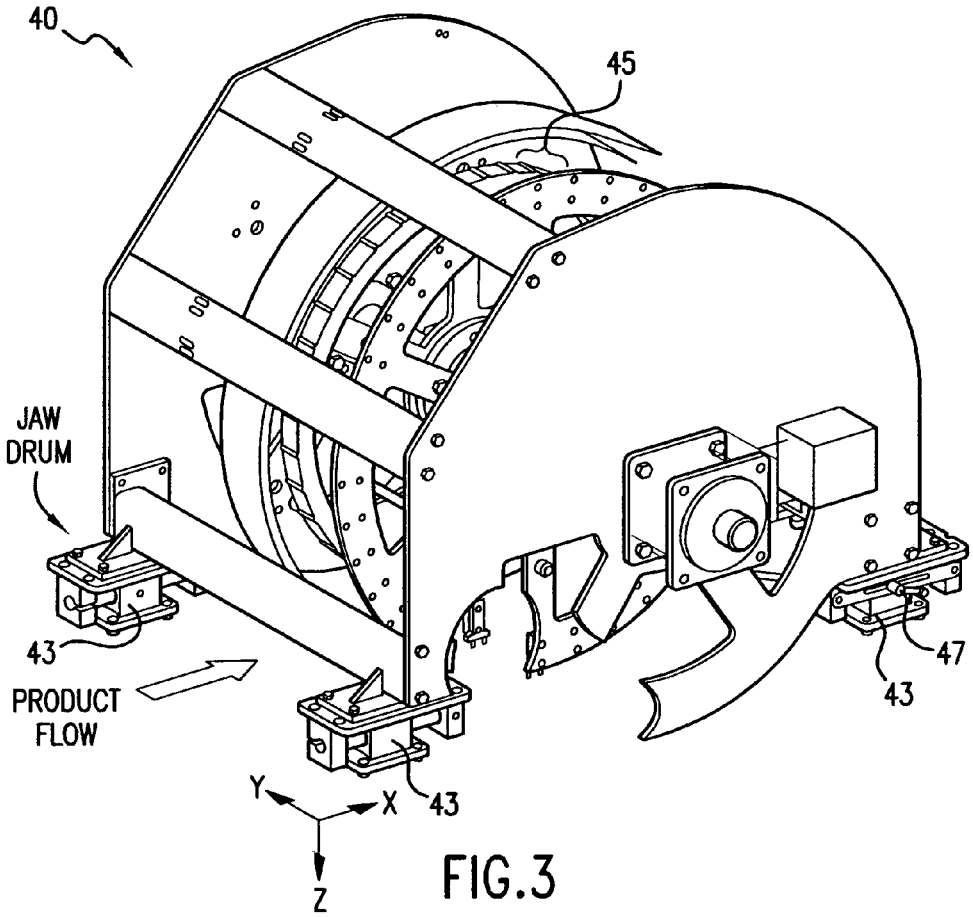
FIG. 3 is a side perspective cutaway view of a jaw drum according to one preferred embodiment of this invention.

According to a preferred embodiment of this invention, jaw drum 40 is moved to a second position 37 that is both forward and transverse/lateral relative to a longitudinal flow direction of the plurality of containers. Jaw drum 40 is thus adapted to move a first distance in a direction transverse to the flow direction and responsively move a predetermined second distance in the flow direction. Such movement, in the y and x directions, respectively, as shown in FIGS. 3 and 4, is preferably accomplished using mounting blocks 43. Jaw drum 40 is preferably slidable along each mounting block 43 at a forward angle relative to flow of the containers so that the second position of jaw drum 40 is different in both the x and y directions relative to the first position. As shown in FIG. 4, a center plane 62 of fixed jaw 55 may be adjusted inward a distance L or outward a distance L', depending upon the desired application. Preferably, a diagonal sliding motion of jaw drum 40 is accomplished using mounting blocks 43 having internal slots extending diagonally relative to flow of the containers. Jaw drum 40 is preferably adjustable between the first position 33 and the second position 37 without the use of tools, such as with locking levers 47 which may be loosened by hand to permit sliding jaw drum 40 relative to mounting blocks 43.

According to one preferred embodiment of this invention, jaw drum 40 is additionally moveable vertically (in the z axis as shown in FIGS. 3 and 4) relative to inlet conveyor 20 and the plurality of containers. As shown schematically in FIG. 1, jaw drum 40 may be positioned on one or more linear actuators 32 that are manually and/or electronically adjustable up or down. Accordingly, when jaw drum 40 is moved from the first position 33 for a RAC configuration to the second position 37 for a SAC configuration, jaw drum 40 is lowered relative to inlet conveyor 20 so that jaw pairs 45 are positioned lower along the container to facilitate placement of carrier stock 15 around the sidewall of the container.

Finally, to transfer between RAC and SAC configurations, jaw drum 40 is adjustable to control the spacing between moveable jaw 50 and fixed jaw 55 within jaw pairs 45. In addition, such spacing may be adjusted to accommodate a group of containers having a different diameter or to engage carrier 10 having a different width. As a result, the distance between moveable jaw 50 and fixed jaw 55 in the open position is reduced or expanded to permit engagement of different carrier stock 15 with jaw pairs for application. According to one preferred embodiment of this invention, the distance between moveable jaw 50 and fixed jaw 55 in each jaw pair 45 is adjustable by adjusting cam 60 either closer or farther away from cam follower 65 to thereby control the distance between moveable jaw 50 and fixed jaw 55 in the open position.

As shown in FIGS. 4 and 5, cam 60 may be adjusted by disengaging lock lever 57 to permit movement of cam 60 using adjustment wheel 59. Adjustment wheel 59 is preferably freely adjustable between two stops to move cam 60 either inward or outward thereby changing the distance between moveable jaw 50 and fixed jaw 55 in the open position. As a result of movement of cam 60 inward or outward, moveable jaw 50 is repositioned relative to fixed jaw 55 so that jaw pairs 45 are properly positioned to correspond with the repositioning of jaw drum 40 in a first position 33 for a RAC configuration or a second position 37 for a SAC configuration. Therefore, jaw pairs 45 maintain the proper spacing to either apply carrier stock 15 along a chime of the container for a RAC configuration or further down along a sidewall of the container for a SAC configuration.

Figure 22:
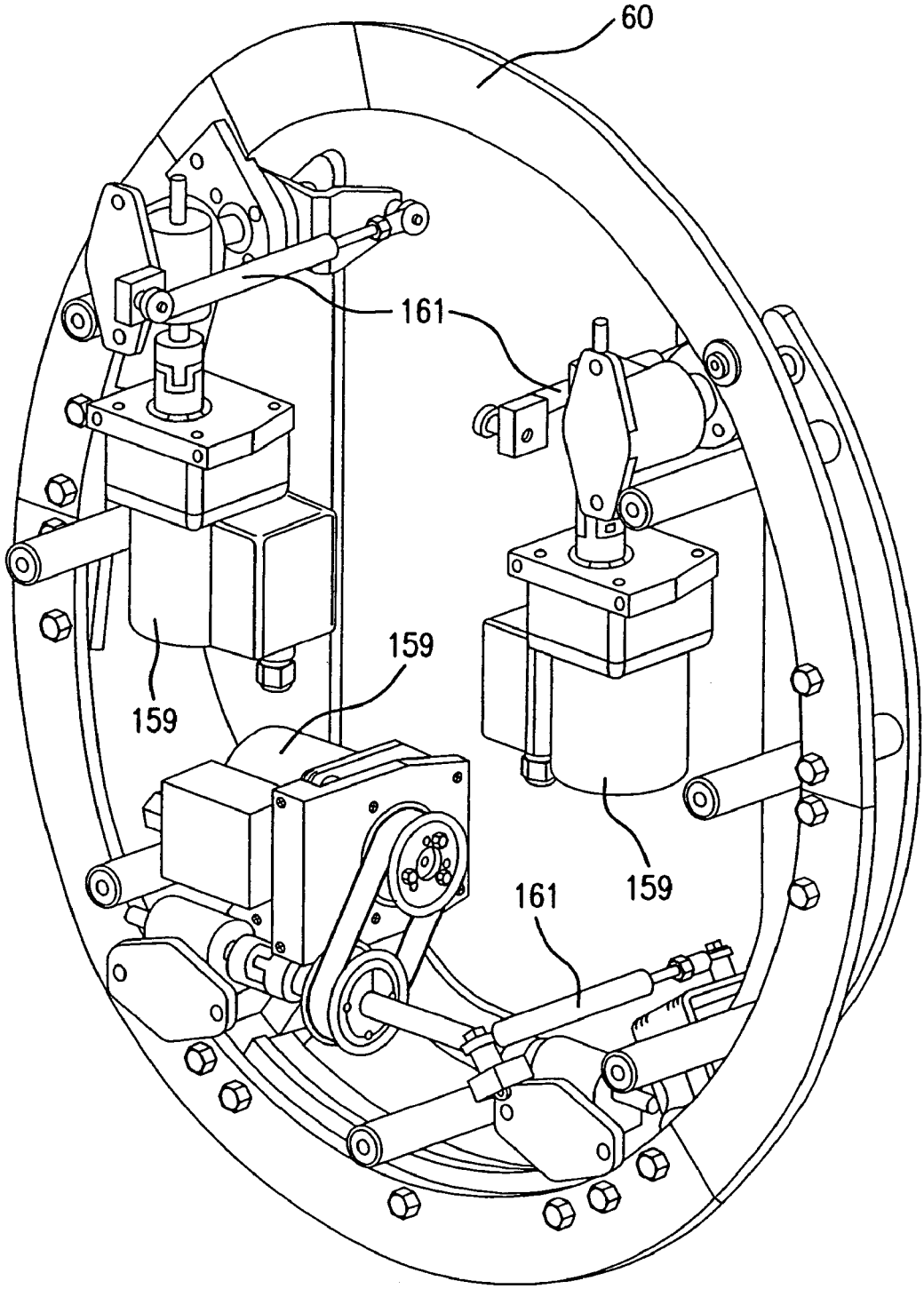
FIG. 22 is a side perspective cutaway view of a portion of a jaw drum according to one preferred embodiment of this invention.

According to another preferred embodiment of this invention, jaw drum 40, as shown in FIG. 22, includes cam 60 that is adjusted automatically with one or more motors 159 instead of adjustment wheel 59 as described above. Motors 159 may include a displacement feedback device 161 that provides feedback to preferably adjust jaw drum 40 between two stops to move cam 60 either inward or outward thereby changing the distance between the moveable jaw and the fixed jaw in the open position. As a result of movement of motors 159 and thus cam 60 inward or outward, the moveable jaw is repositioned relative to the fixed jaw so that jaw pairs are properly positioned to correspond with the repositioning of jaw drum 40 in the first position for a RAC configuration or the second position for a SAC configuration. This embodiment of jaw drum 40 may save space over a manual adjustment mechanism shown in FIGS. 4 and 5. In addition, operation of motors 159 preferably occurs automatically in response to an initial setup of machine 10.

Figure 23:
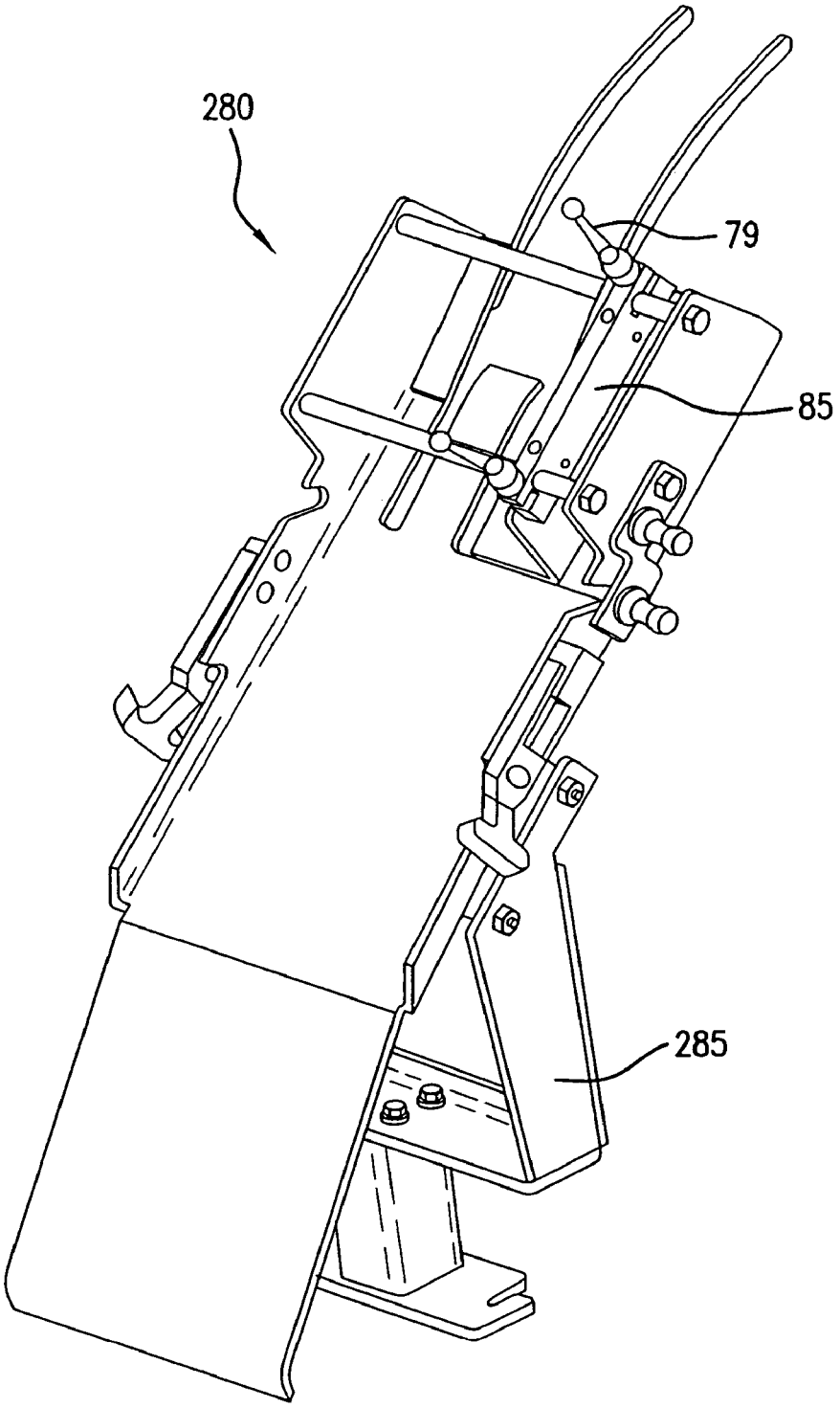
FIG. 23 is a side perspective view of a feed trough according to one preferred embodiment of this invention.

According to another preferred embodiment of this invention, as shown in FIG. 23, feed trough 280 may include bracket 285 or similar element that cooperates with a proximity sensor (not shown) positioned within jaw drum 40. Prior to any automatic movement of jaw drum 40 by motors 159, feed trough 280 preferably must be removed and/or repositioned relative to jaw drum 40. As such, the proximity sensor connected between feed trough 280 and jaw drum 40 detects a connection or lack of a connection of feed trough 280 to jaw drum 40 thereby preventing or permitting movement of jaw drum 40 with motors 159.

Stripper Shoe

As best shown schematically in FIG. 8, after carrier stock 15 is applied to containers at the proper position along the chime for the RAC configuration or around the sidewall for the SAC configuration, carrier stock 15 is stripped from jaw pairs 45 using stripper shoe 95 having plow 97 that includes a suitable profile to detach carrier stock 15 from jaw pairs 45 as jaw drum 40 rotates away from stripper shoe 95. According to a preferred embodiment of this invention, plow 97 is interchangeable within stripper shoe 95 depending upon the size of containers being packaged and/or whether the packages are in a SAC or RAC configuration.

Preferably, plow 97 having a deep curved profile is used to detach SAC configuration carrier stock 15 from containers. Plow 97 having a generally flat profile may be used to strip RAC configuration carrier stock 15 from the containers because carrier stock 15 does not extend deep into the center of the package created by applying carrier stock 15 to the chime of the container. Plows 97 may be suitably coded to easily identify the correct plow 97 for use with each configuration.

Cutoff Wheel

After carrier stock 15 is stripped from jaw pairs 45, a continuous string of unitized containers proceeds to outlet conveyor 30 and through cutoff wheel 100. Cutoff wheel 100 includes a plurality of container pockets 105 and cuts the continuous string of unitized containers into individual packages, including four-packs, six-packs, eight packs, twelve-packs or any other suitably sized package. Container pockets 105 are preferably of a number that equals a lowest common denominator of the sizes of packages to be created, for example twenty-four container pockets 105. According to a preferred embodiment of this invention, cutoff wheel 100 is adjustable without the use of tools to divide packages into any number of desired sizes.

Figure 15:
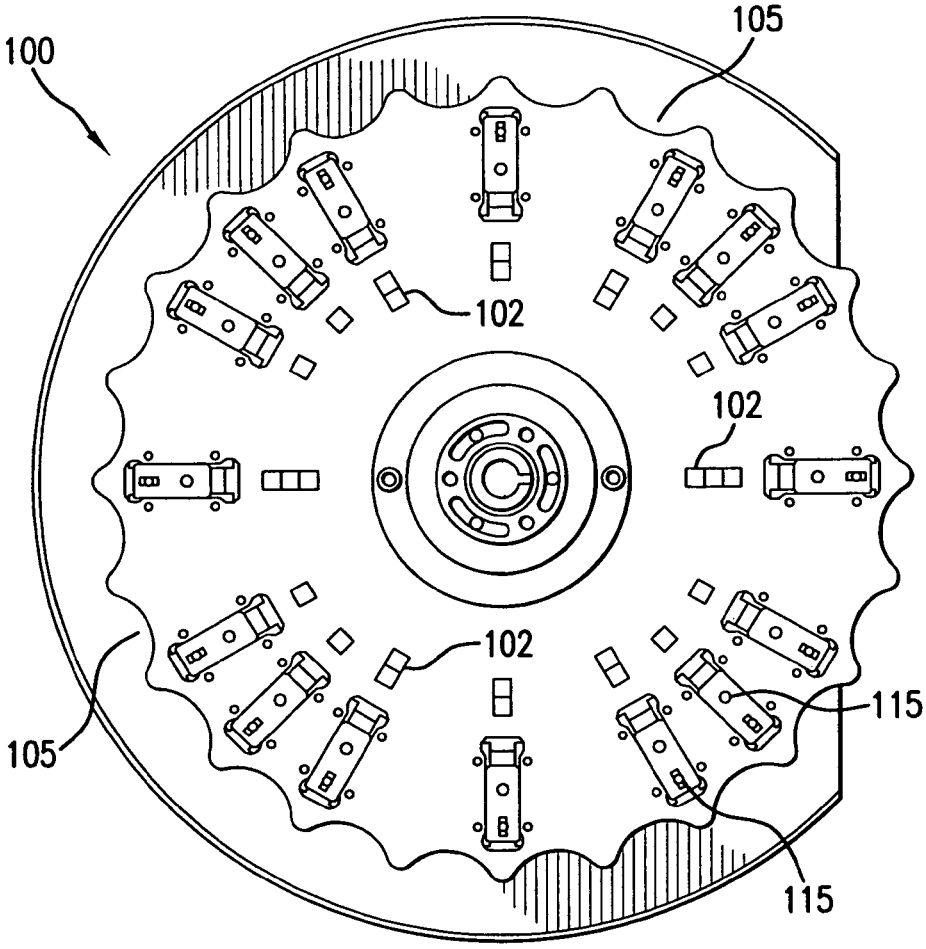
FIG. 15 is a top view of a cutoff wheel according to one preferred embodiment of this invention.
Figure 16:
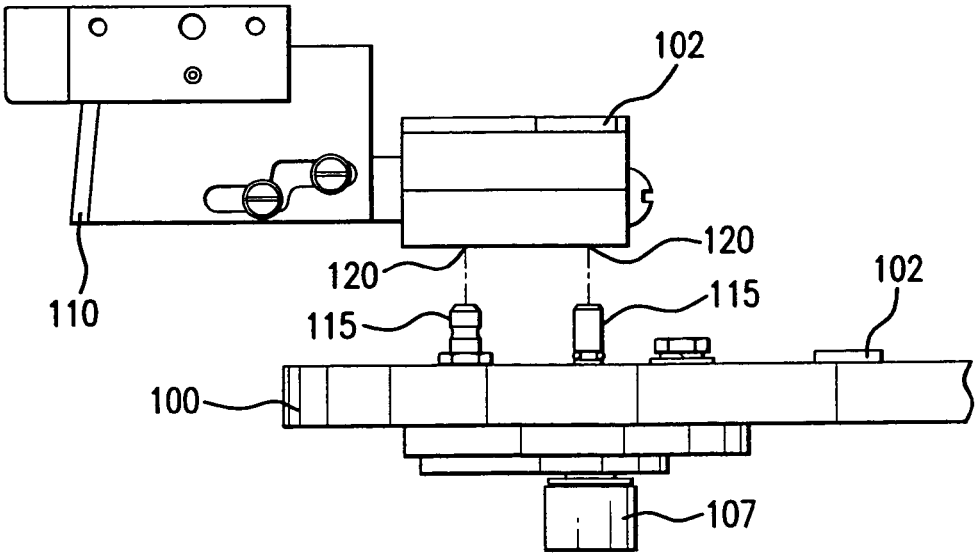
FIG. 16 is side exploded view of a cutoff knife and a cutoff wheel according to one preferred embodiment of this invention.

FIGS. 15 and 16 show a preferred embodiment of cutoff wheel 100 wherein a plurality of knives 110 are positioned around a perimeter of cutoff wheel 100 at appropriate increments based upon a desired size of the package. For instance, if a six-pack is desired, knives 110 are positioned in between every three container pockets 105 to cut carrier stock 15 into packages having three ranks of two rows of containers. Likewise, if an eight-pack is required, knives 110 are positioned in between every four container pockets 105 to cut carrier stock 15 into packages having four ranks of two rows of containers.

Knives 110 are preferably removable from cutoff wheel 100 using one or more studs 115 positioned on cutoff wheel 100 interlocking with corresponding receivers 120 positioned within knives 110, such as shown in FIG. 16. Other methods of attaching knives 110 to cutoff wheel 100 are also possible, provided such methods provide quick and efficient removability and replaceability.

To facilitate changeover between sizes of packages in machine 10, knives 110 are preferably interchangeable and replaceable using a coded marking system 102, for example color, shape and/or number codes. Accordingly, each operative location around cutoff-wheel 110 is coded with, for example, one or more colors that indicate the appropriate size of package. For example, each location between container pockets 105 in cutoff wheel 100 that contains an adjacent blue-coded mark would be suitable for positioning knives between every three container pockets 105 to create a six-pack configuration. Thus, cutoff wheel 100 would include eight blue-coded marks around its perimeter. Knives 110 may also be coded and grouped according to the desired configuration. Each position between adjacent container pockets 105 around cutoff wheel 100 may include multiple color-coded marks because a number of sizes (i.e. four-packs and eight-packs) may be divided at common points around cutoff wheel 100.

Knives 110 may further include cam follower 107 operatively associated with studs 115 to follow a cam (not shown) positioned underneath cutoff wheel 100 so that knife 110 extends at the position closest to carrier stock 15 to facilitate cutting of carrier stock 15. Cam is preferably generally circular with a rise or nub extending outward toward outlet conveyor 30 at a mating point between knife 110 and carrier stock 15.

Turner/Diverter

As shown in FIG. 1, individual packages then proceed from cutoff wheel 100 along outlet conveyor 30 to discharge conveyor 160 and turner/diverter 130. Turner/diverter 130 is preferably positioned over discharge conveyor 160 and is used to move, align and/or realign the individual packages into a desirable discharge pattern for placement by a case packer into boxes and/or pallets and/or other shipping containers. For example, turner/diverter 130 may be used to rotationally realign six-packs from a two wide position as they emerge from the cutoff wheel 100 to a three wide position and on to a case packer to place in corrugated cardboard trays.

Figure 17:
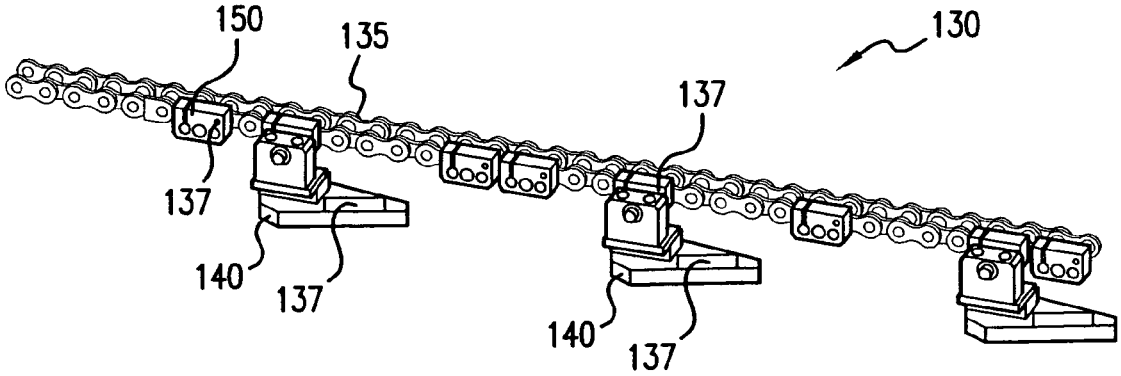
FIG. 17 is a side perspective view of a turner/diverter chain and lugs according to one preferred embodiment of this invention.

Turner/diverter 130 preferably includes chain 135 having a plurality of lug mounts 150 and one or more lugs 140 connected to one or more of the plurality of lug mounts 150. Like cutoff wheel 100, turner/diverter 130 is preferably adjustable to accommodate any number of configurations of packages and/or requirements for discharge to shipping containers. According to one preferred embodiment of this invention, each lug mount 150 includes a coded marking system 137, such as colors, shapes and/or numbers. As shown in FIG. 17, each lug mount 150 is numbered sequentially and each corresponding lug 140 is preferably color coded and/or numbered to indicate the relative position around chain 135 and the configuration of lug 140. Lugs 140 may be configured to turn packages, to divert packages and/or to maintain a linear position of packages. As shown in FIG. 17, each lug 140 may include one or more numbers on a colored background. Therefore, for a six-pack configuration, a blue square may include the numbers of three different lug mounts (2, 4 and 7) and lugs 140 are accordingly positioned on the lug mounts 150 numbered "2," "4," and "7." Lugs 140 are preferably removable and replaceable without tools, such as with a stud/receiver arrangement similar to that used with knives 110 on cutoff wheel 100.

Turner/diverter 130 is also adjustable up and down relative to discharge conveyor 160 using one or more linear actuators 132 controlled electronically and/or manually. Adjustment of linear actuators 132 enable turner/diverter 130 to properly address packages of different heights.

Figure 24:
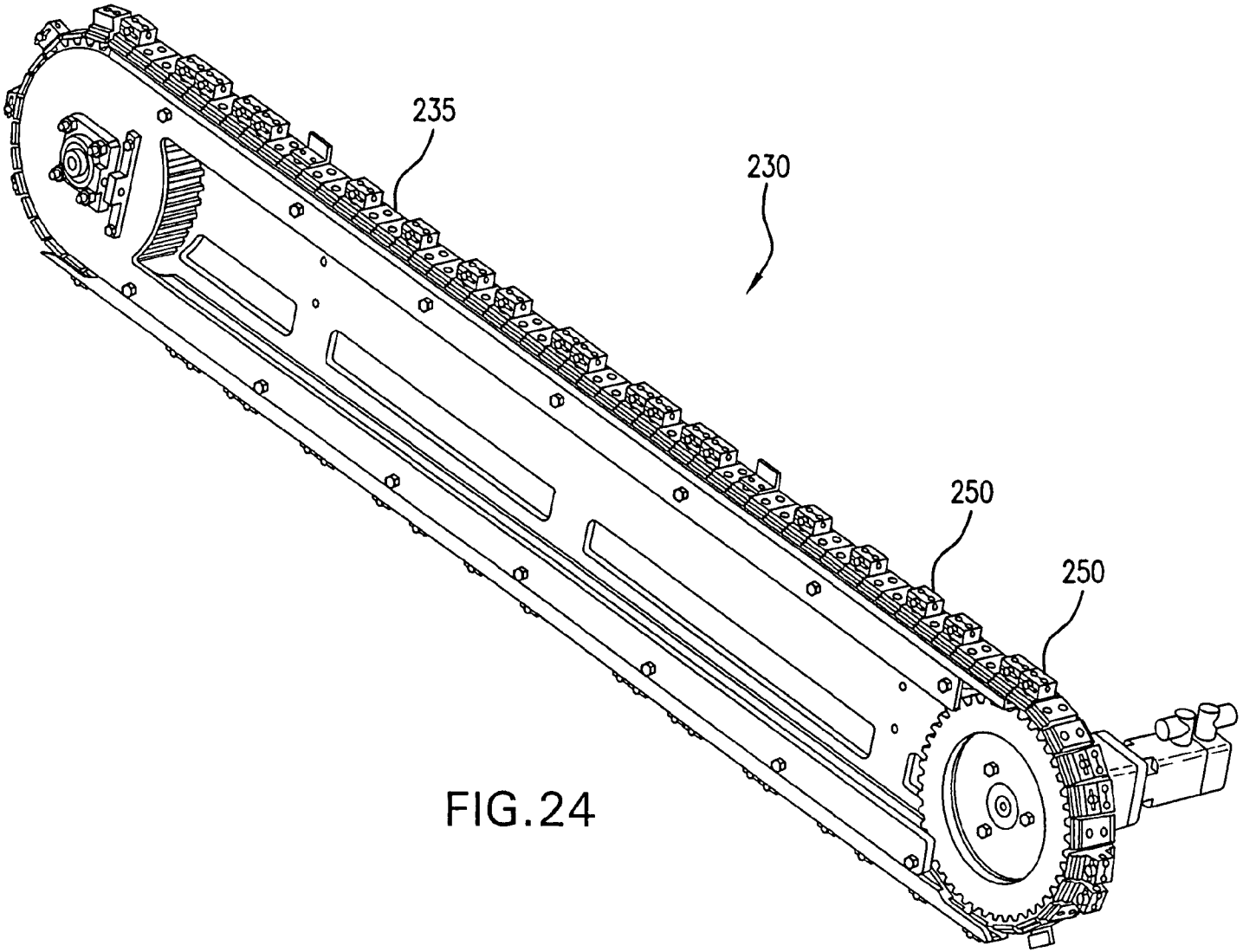
FIG. 24 is a side perspective view of a turner/diverter belt according to one preferred embodiment of this invention.
Figure 25:
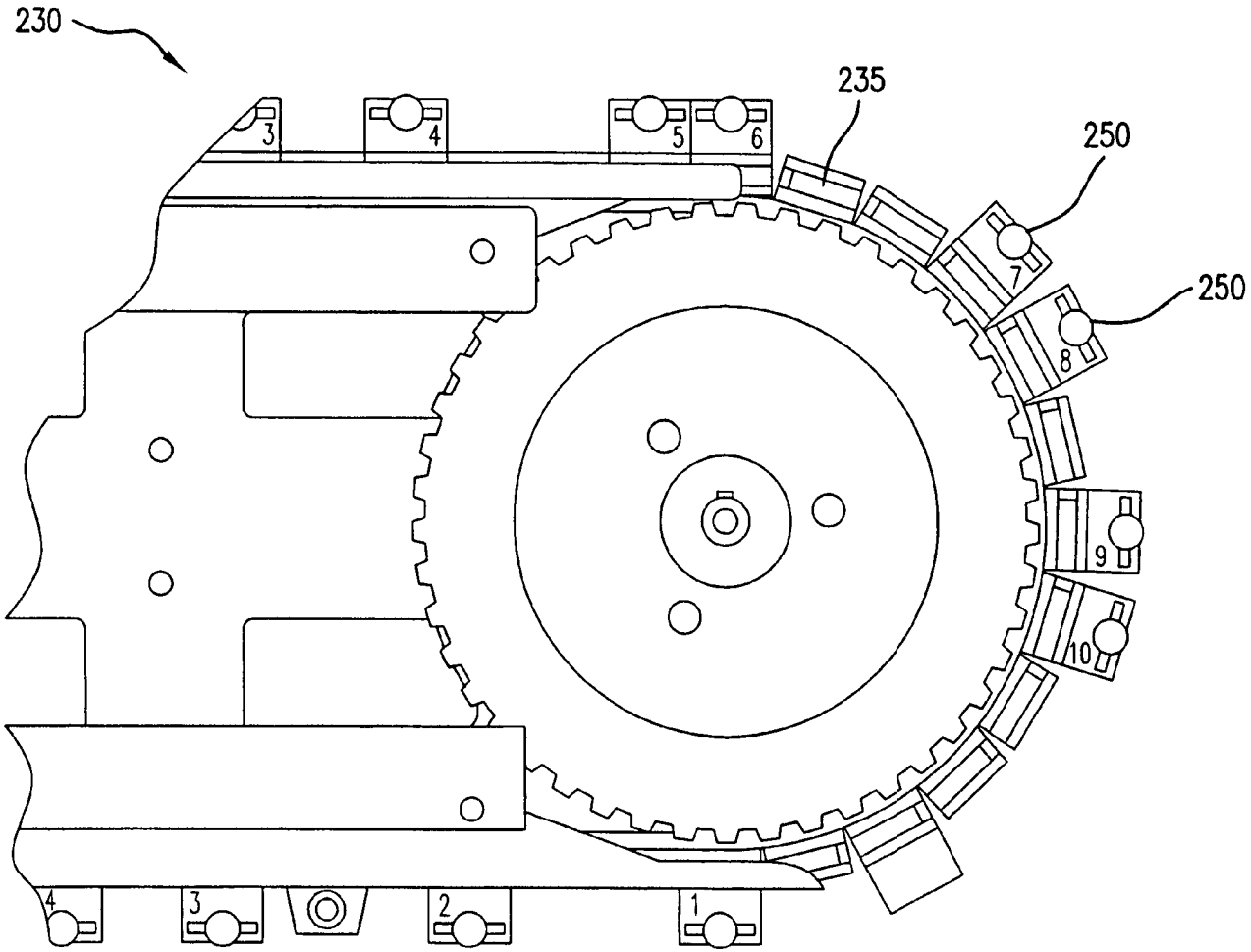
FIG. 25 is a side view of the turner/diverter belt shown in FIG. 24.
Figure 26:
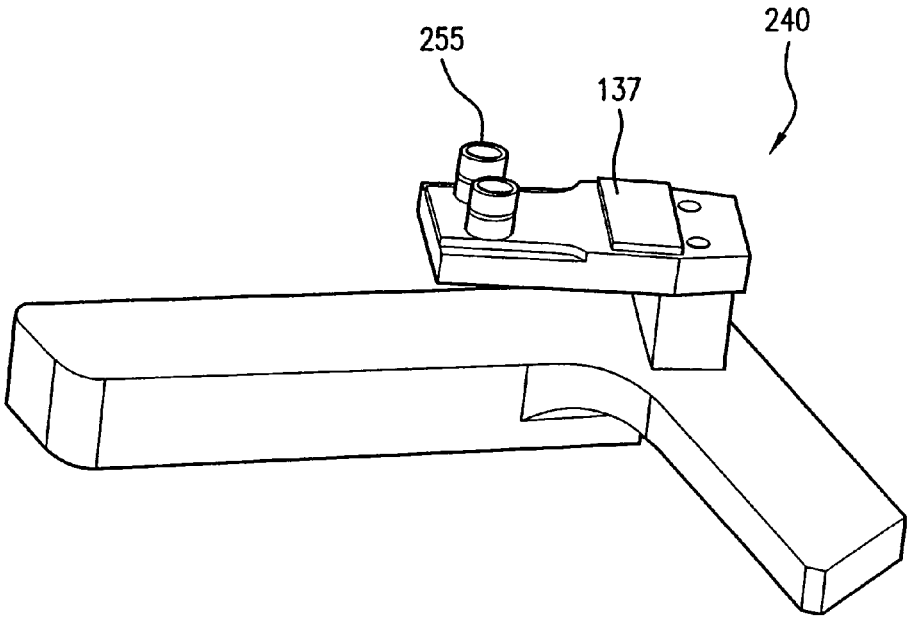
FIG. 26 is a side perspective view of a lug for use with the turner/diverter belt shown in FIGS. 24 and 25.

According to another preferred embodiment of this invention shown in FIGS. 24–26, turner/diverter 230 may include belt 235 instead of chain 135. Belt 235 provides quieter operation than chain 135 and does not require lubrication. In addition, belt 235 does not stretch thereby providing consistent and repeatable positioning of lugs 240. As shown in FIG. 26, lug 240 may include coded marking system 137, such as one or more numbers on a colored background to suitably adjust the configuration of turner/diverter 230 based upon the desired configuration of package and/or carrier. Lug 240 may additionally include posts 255 to provide quick connection to lug mounts 250 on turner/diverter 230.

Package Guides

Figure 18:
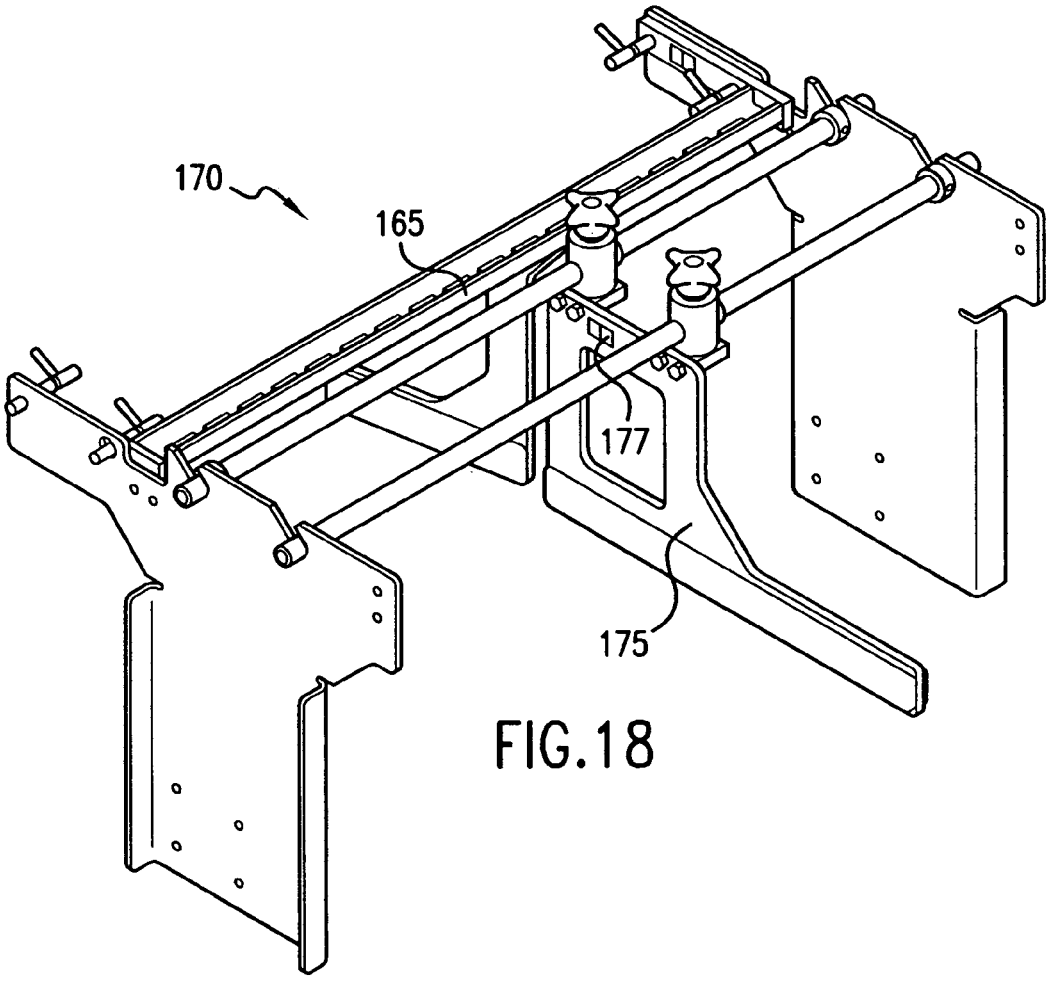
FIG. 18 is a side perspective view of a package guide according to one preferred embodiment of this invention.

Once the packages are properly turned and/or diverted, they proceed down discharge conveyor 160 and through package guide 170, such as shown in FIG. 18. Package guide 170 preferably includes adjustable guides 165 and one or more replaceable rails 175. Adjustable guides 165 and replaceable rails 175 are preferably adjustable/replaceable without the use of tools. For example, if a six-pack is three wide as it is fed into package guide 170, a corresponding three wide replaceable rail 175 is inserted into package guide 170 and adjustable guide 165 is additionally adjusted into the corresponding width.

Package guide 170 thereby provides a rigid path in which the aligned package may proceed to a corrugated cardboard tray or a case packer. Package guide 170, and specifically replaceable rails 175, may be coded with coded marking system 177, such as with colors, to distinguish among proper replaceable rails 175 and positioning of adjustable guides 165. For example, replaceable rail 175 having a blue code may be used to guide six-packs off of machine 10. Package guide 170 may include an integrated sensor to detect jams in packages as they proceed from discharge conveyor 160.

Orienter

According to one preferred embodiment of this invention, shown in FIG. 27, machine 10 further includes orienter 200. Orienter 200 is preferably used to rotate individual containers into a desired rotational orientation prior to packaging. FIG. 27 shows machine 10 wherein orienter star wheel 90' feeds containers to orienter 200 and, following orientation, such containers are maintained in an oriented position by star wheel 90 prior to unitization at jaw drum 40. Star wheel 90 according to this embodiment of the invention may include pockets 93 having flexible inserts or similar device for maintaining a fixed orientation of the oriented containers as they pass from orienter 200 to jaw drum 40.

In operation, orienter 200 may include camera 210 and vision/orientation controller 220 for identifying a correct rotational position of the container and then fixing such container into such rotational position. Orienter 200 preferably rotates containers in either direction depending upon the most efficient rotational path that results in an oriented container.

Machine Drive

FIG. 27 shows one preferred embodiment of the subject invention. Each of the components shown in FIG. 27 preferably includes an associated drive, either electrical or mechanical. The associated drive may include a servo motor providing power and feedback or a simple motor providing only power. According to one preferred embodiment of this invention, a drive electrically connects orienter 200 with respect to at least one other component of machine 10 including feed drum 70, jaw drum 70, turner/diverter 130 and/or input conveyor 20. In addition, star wheel 90 and cutoff wheel 100 are preferably mechanically connected with orienter 200 such that the movement orienter 200 directly translates to movement of star wheel 90 and cutoff wheel 100.

Figure 28:
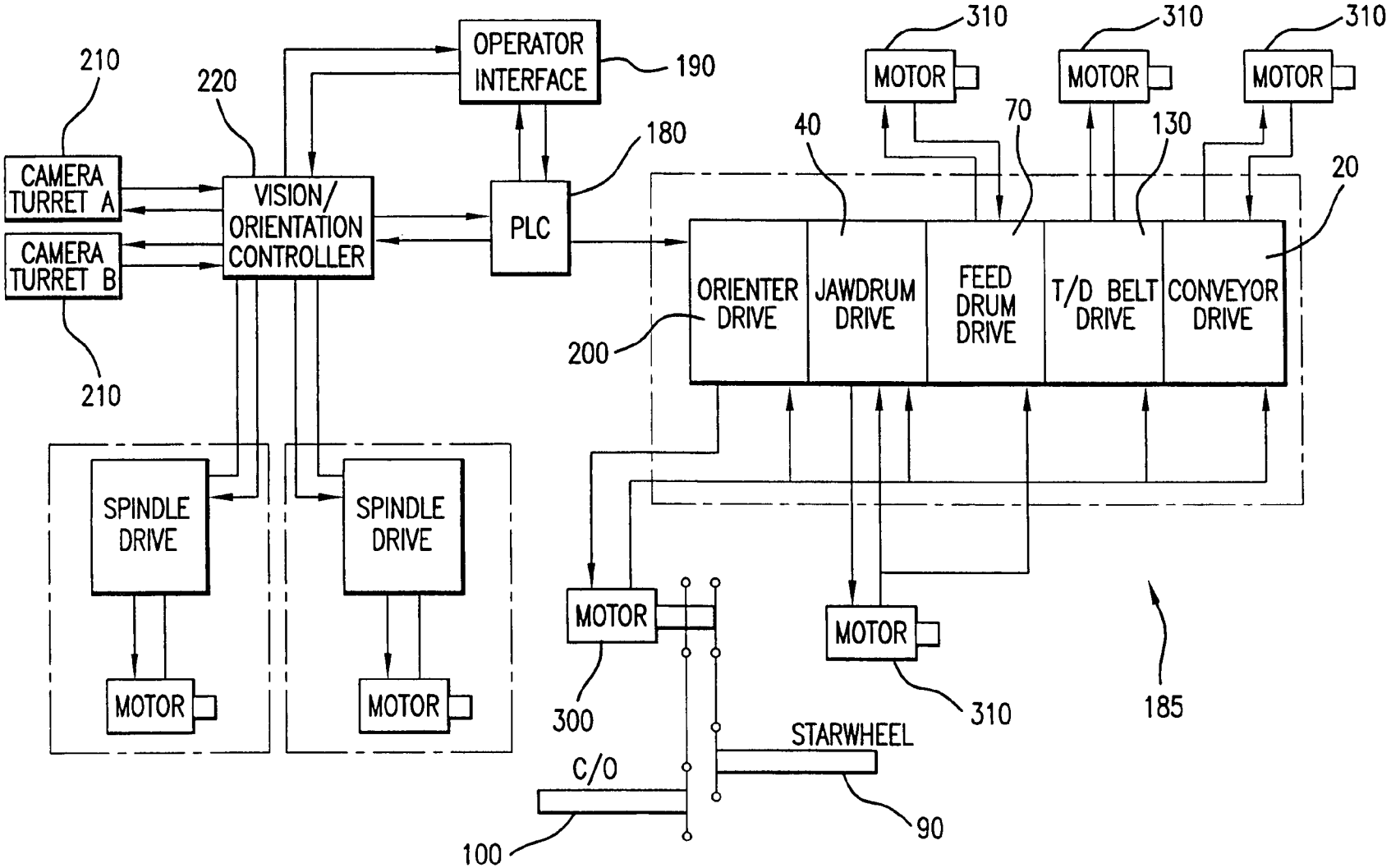
FIG. 28 is a schematic of the electronic relationship among components within a machine for packaging containers according to one preferred embodiment of this invention.

According to a preferred embodiment of this invention, a drive speed of each moving component of machine 10 is timed and maintained using suitable electronic controls. Controller 180, such as a PLC, is preferably electrically connected to a suitable moving component of machine 10, for instance to orienter 200. Controller 180 is electrically connected to jaw drum 40, feed drum 70, input conveyor 20 and/or turner/diverter 130 resulting in coordinated movements of these mechanisms relative to each other. FIG. 28 shows a schematic of such electronic control among the various components of machine 10, including orienter 200. As described herein, each referenced component (jaw drum 40, feed drum 70, etc.) actually includes a corresponding motor that powers a respective drive of such referenced component. Such motors are shown schematically in FIG. 28.

According to a preferred embodiment of this invention, the feedback of orienter 200 provides a command signal for jaw drum 40, turner/diverter 130 and input conveyor 20. The feedback of jaw drum 40 preferably provides a command signal for feed drum 70. Preferably, each motor includes a feedback signal with the drive of each respective component. This arrangement provides a closed loop that permits controller 180 to adjust a speed of the motors so that an actual position of the respective component is very close to a commanded position of the respective component.

As a result, jaw drum 40 may be registered relative to a home position of a container based upon signals received from controller 180. Likewise, feed drum 70 preferably provides carrier stock 15 to jaw drum 40 at a pace generated by signals received from controller 180. In addition, turner/diverter 130 preferably operates to position packages along discharge conveyor 160 at a speed responsive to signals received from controller 180. As a result of the described relationship among the various drive mechanisms in machine 10, various mechanical adjustments are unnecessary among such drive mechanisms when switching between different containers, different carriers, different package configurations and other changes that may result in a change in operating characteristics of machine 10.

According to a preferred embodiment of this invention, the relationship between controller 180 and each of orienter 200, feed drum 70, jaw drum 40 and turner/diverter 130 enables precise interaction among each respective component. Therefore, as shown in FIG. 28, controller 180 provides a signal to a master motor 300 driving orienter 200 which subsequently directs each of feed drum 70, input conveyor 20 and turner/diverter 130. Each additional motor 310 driving feed drum 70, input conveyor 20 and/or turner diverter 130 correspondingly provides feedback to the master motor 300 regarding the relative location of each component. Therefore, the movements of each of feed drum 70, jaw drum 40 and/or turner/diverter 130 are continually coordinated through controller 180.

In addition, and as shown in FIG. 28, star wheel 90 and cutoff wheel 100 are mechanically connected with the motor driving orienter 200 thereby resulting in fixed movement between orienter 200 and star wheels 90, 90' and orienter 200 and cutoff wheel 100.

As further shown in FIG. 28, according to a preferred embodiment of this invention having orienter 200, controller 180 additionally communicates with vision/orientation controller 220 which in turn communicates with cameras 210, spindle drives and spindle motors associated with orienter 200. The spindle drives and spindle motors operate to rotate each container into an oriented position and are not used to drive orienter 200.

Interface

Figure 19:
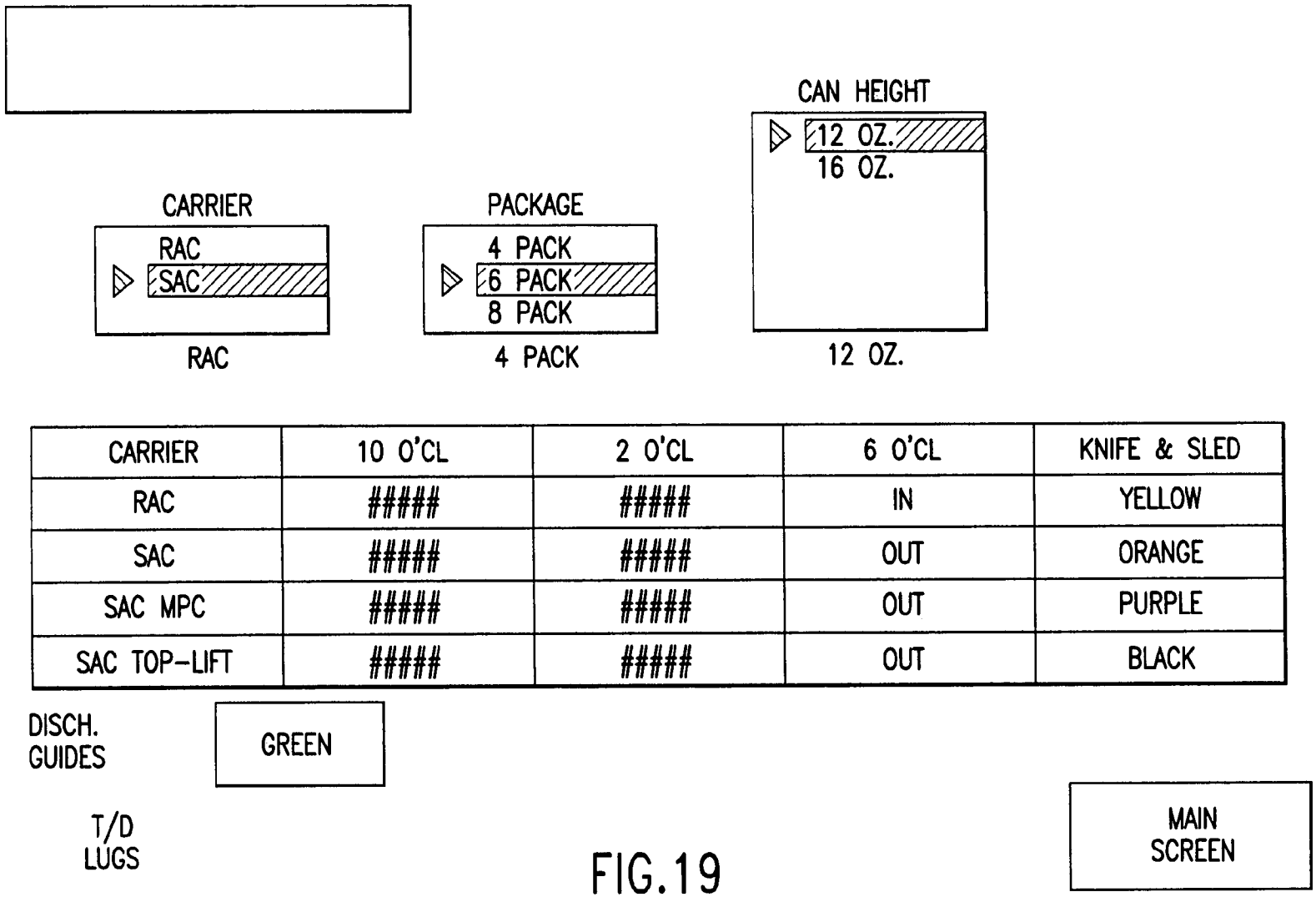
FIG. 19 is a screen shot of an electronic interface according to one preferred embodiment of this invention.

According to a preferred embodiment of this invention, machine 10 further includes an electronic interface 190, such as a touchscreen. Electronic interface 190 is preferably configured to interactively program any number of packaging options, such as with a representative screen shot shown in FIG. 19. An operator can preferably program the size of the desired package (i.e., number of containers), the configuration of the desired package (i.e., SAC or RAC), the type of container (i.e., bottle or can), the height of container (i.e. 12 oz. or 16 oz.) and/or the style of carrier (i.e., with or without handles, display panels, etc.).

For instance, electronic interface 190 preferably includes a coded instruction set that matches the coding found in cutoff wheel 100 and turner/diverter 130. For example, a series of colored boxes may be indicated on a screen, each colored box showing a number corresponding with a size of the desired package. Therefore, if an operator selects a blue box (for a six-pack), the operator accordingly will know or be instructed to set-up cutoff wheel 100 with appropriately coded (blue) knives 110 and/or turner/diverter 130 with appropriately coded (blue) lugs 140 and/or package guide 170 with appropriately coded (blue) replaceable rails 175.

Electronic interface 190 may further include interface regarding speed of machine 10. Such speed (or ratio of speeds) is then signaled and maintained by controller 180 using signals generated among controller 180, feed drum 70, jaw drum 40, input conveyor 20, orienter 200 and/or turner/diverter 130.

In addition, electronic interface 190 may include instructions and/or inputs for changing a configuration of the desired package. Depending upon whether SAC or RAC packages are required, operator may be instructed to adjust jaw drum 40 accordingly. In addition, instructions and/or electronic signals may be generated to jaw drum 40 and/or turner/diverter 130 to correspondingly raise or lower each respective component into a required position using linear actuators 32, 132, respectively.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

I claim:

1. A machine for packaging a plurality of containers into packages using flexible carrier stock, the machine comprising:

a feed drum adapted to feed the flexible carrier stock;

a jaw drum adapted to draw the flexible carrier stock from the feed drum and apply the flexible carrier stock to the plurality of containers, wherein the jaw drum is adapted to slide at an angle relative to a flow of the containers;

a turner/diverter device adapted to move and forward packages in a desired alignment; and a controller adapted to electronically coordinate the movement of the feed drum, the jaw drum and the turner/diverter device so that an actual position of each of the feed drum, the jaw drum and the turner/diverter device corresponds with a commanded position of each respective device.

2. The machine of claim 1 further comprising:

a cutoff wheel for dividing the carrier stock into packages.

3. The machine of claim 2 wherein the cutoff wheel further comprises:

a plurality of knives;

a coded marking system associated with each knife of the plurality of knives, the coded marking system adapted to indicate a proper arrangement of the plurality of knives based upon a configuration of the package.

4. The machine of claim 1 wherein the turner/diverter device further comprises:

a plurality of lugs; and a coded marking system associated with each lug of the plurality of lugs, the coded marking system adapted to indicate a proper arrangement of the plurality of lugs based upon a configuration of the package.

5. The machine of claim 4 wherein the plurality of lugs are interchangeably positionable in a plurality of lug mounts, each lug mount having a corresponding coded marking system.

6. The machine of claim 1 further comprising:

a motor connected with the jaw drum, the motor automatically adjusting a distance between each pair of jaws of a plurality of jaw pairs within the jaw drum.

7. The machine of claim 1 further comprising:

a feed trough connected to the jaw drum for feeding the flexible carrier stock to the jaw drum; and a proximity sensor connected between the feed trough and the jaw drum to detect a connection of the feed trough to the jaw drum.

8. A machine for packaging a plurality of containers using flexible carrier stock, the machine comprising:

a feed drum adapted to feed the flexible carrier stock;

a jaw drum adapted to draw the flexible carrier stock from the feed drum and apply the flexible carrier stock to the plurality of containers, wherein the jaw drum is adapted to move a first distance in a direction transverse to a flow of the flexible carrier stock and a second distance with the flow of the flexible carrier stock; and a controller and an electronic drive adapted to coordinate the movement of the feed drum and the jaw drum.

9. The machine of claim 8 further comprising:

a turner/diverter device adapted to forward packages in a desired discharge pattern, the turner/diverter device further connected with respect to the controller and the electronic drive to coordinate a speed of the turner/diverter device with a speed of the jaw drum and a speed of the feed drum.

10. The machine of claim 8 further comprising:

an orienter adapted to orient containers, the controller and the electronic drive electrically connected to the orienter to coordinate a speed of the orienter with a speed of the feed drum.

11. The machine of claim 8 further comprising:

a star wheel adapted to feed containers to the jaw drum, the star wheel mechanically connected to the jaw drum.

12. The machine of claim 8 wherein the jaw drum further comprises:

an adjustment mechanism for adjusting the distance between each pair of jaws in the plurality of jaw pairs.

13. The machine of claim 8 further comprising:

one or more linear actuators associated with the jaw drum and adapted to adjust a vertical height of the jaw drum.

14. The machine of claim 8 wherein the jaw drum further comprises:

a motor connected with the jaw drum, the motor automatically adjusting a distance between each jaw pair of the plurality of jaw pairs within the jaw drum to apply the flexible carrier stock to different carrier or container configurations.

15. The machine of claim 14 further comprising:

a feed trough connected to the jaw drum; and a proximity sensor connected between the feed trough and the jaw drum, the proximity sensor preventing movement of the motor when the feed trough is improperly positioned.

16. The machine of claim 8 further comprising:

a turner/diverter device connected downstream of the jaw drum and adapted to forward packages in a desired discharge pattern, the turner/diverter device comprising a flexible belt having interchangeable lugs.

* * * * *